United States Patent [19]

Hirose et al.

[11] Patent Number: 4,857,444

[45] Date of Patent: Aug. 15, 1989

[54] COLOR PHOTOGRAPHIC LIGHT-SENSITIVE MATERIAL

[75] Inventors: Takeshi Hirose; Tadashi Ogawa; Nobuo Furutachi, all of Kanagawa, Japan

[73] Assignee: Fuji Photo Film Co., Ltd., Kanagawa, Japan

[21] Appl. No.: 947,443

[22] Filed: Dec. 29, 1986

[30] Foreign Application Priority Data

Dec. 27, 1985 [JP] Japan ..... 60-295895

[51] Int. Cl.[4] ..... G03C 7/32

[52] U.S. Cl. ..... 430/505; 430/512; 430/549; 430/551; 430/552; 430/553; 430/556; 430/557; 430/558

[58] Field of Search ..... 430/505, 512, 551, 549, 430/558, 552, 553, 556, 557

[56] References Cited

U.S. PATENT DOCUMENTS

| | | | |
|---|---|---|---|
| 4,500,630 | 2/1985 | Sato et al. | 430/386 |
| 4,559,297 | 12/1985 | Seto et al. | 430/551 |
| 4,622,287 | 11/1986 | Umemoto | 430/505 |
| 4,623,617 | 11/1986 | Kaneko et al. | 430/551 |
| 4,639,415 | 1/1987 | Kaneko et al. | 430/558 |
| 4,748,100 | 5/1988 | Umemoto et al. | 430/505 |

FOREIGN PATENT DOCUMENTS

| | | | |
|---|---|---|---|
| 0161577 | 11/1985 | European Pat. Off. | 430/549 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material is disclosed, comprising a support having provided thereon a red-sensitive layer, a green-sensitive layer, and a blue-sensitive layer, in which at least one of couplers represented by the formulae (I) and/or (II), at least one of couplers represented by the following formula (III), and at least one of couplers represented by the following formula (IV) are respectively incorporated in the light-sensitive layers different from each other in color sensitivity:

(I)

(II)

(III)

(IV)

wherein:

$R_1$, $R_2$, $R_4$ each represents a substituted or unsubstituted aliphatic, aromatic or heterocyclic group;

$R_3$, $R_5$, and $R_6$ each represents a hydrogen atom, a halogen atom, an aliphatic group, an aromatic group, or an acylimino group or, when taken together, $R_3$ and $R_2$ represent non-metallic atoms necessary for forming a nitrogen-containing 5- or 6-membered ring;

$R_7$ represents an alkoxy group, an aryloxy group, or a heterocyclic oxy group;

$R_8$ represents a substituted or unsubstituted N-phenylcarbamoyl group;

Za and Zb each represents methine, substituted methine, or =N—;

$Y_1$, $Y_2$, $Y_3$ and $Y_4$ each represents a hydrogen atom or a group capable of being split off upon coupling reaction with an oxidation product of a developing agent; and n represents 0 or 1.

The photographic material of the invention is good in color forming properties, improved in color reproducibility and preservability of images, and is free from destroy in color balance.

32 Claims, No Drawings

COLOR PHOTOGRAPHIC LIGHT-SENSITIVE MATERIAL

FIELD OF THE INVENTION

The present invention relates to a multilayered silver halide color photographic material and more particularly, to a multilayered silver halide color photographic material containing a combination of novel couplers, which is good in color forming properties, improved in color reproducibility and preservability of images, and which is free from destroy in color balance (the multilayered silver halide color photographic material is hereinafter often simply referred to as a "photographic material" or "light-sensitive material").

BACKGROUND OF THE INVENTION

In silver halide color light-sensitive materials, a light-sensitive layer comprising three kinds of silver halide emulsion layers which have selectively been sensitized so as to have a sensitivity to blue color, green color and red color, respectively is applied in a multilayered construction onto a support. For example, in a so-called color photographic paper (hereinafter referred to as "color paper"), a red-sensitive emulsion layer, a green-sensitive emulsion layer, and a blue-sensitive emulsion layer are provided usually in that order from the side from which exposure to light is carried out, and a color mixing-preventing or ultraviolet light-absorptive interlayer or protective layer is provided between the respective light-sensitive layers.

Furthermore, in a so-called color positive film, a green-sensitive emulsion layer, a red-sensitive emulsion layer, and a blue-sensitive emulsion layer are provided usually in that order from the side that is far from the support, i.e., the side from which exposure to light is carried out. In a color negative film, the layer arrangement is divergent. That is, while it is general that a blue-sensitive emulsion layer, a green-sensitive emulsion layer, and a red-sensitive emulsion layer are provided in that order from the side from which exposure to light is carried out, in light-sensitive materials having two or more emulsion layers which are sensitive to the same color but different in sensitivity, there are those light-sensitive materials in which an emulsion layer having a different color sensitivity is disposed between said emulsion layers or a bleachable yellow filter layer, an interlayer, a protective layer, and so on are inserted therebetween.

In forming color photographic images, three photographic couplers of yellow, magenta, and cyan are incorporated in light-sensitive layers and, after exposure to light, the resulting light-sensitive material is subjected to color development processing using a so-called color developing agent. Coupling reaction between an oxidation product of an aromatic primary amine and each coupler provides a colored dye. In this reaction, the couplers preferably show a coupling rate as fast as possible so as to provide a high color density within a limited developing time. Further, formed dyes are required to show bright cyan, magenta or yellow hue with less side absorption so as to provide color photographic images having good color reproducibility.

On the other hand, formed color photographic images are required to show good preservability under various conditions. In order to satisfy this requirement, it is of importance that formed dyes with different hues show slow color fading or discoloring rate and that the dyes show discoloring rate as uniform as possible all over the image density region not to make the color balance of the remaining dye image unbalanced.

With conventional light-sensitive materials, particularly color papers, cyan dye images are seriously deteriorated by long-time dark fading due to the influence of humidity and heat and, hence, they are liable to undergo change in color balance, thus being strongly desired to be improved. There has been the tendency that cyan dyes with difficult dark fading show poor hues and are liable to fade and disappear by light, thus a novel combination of couplers has been demanded.

In order to partly solve this problem, there have so far been proposed specific combinations of respective couplers. Some examples thereof are described in, fro example, Japanese Patent Publication No. 7344/77, Japanese Patent Application (OPI) Nos. 200037/82, 57238/84, and 160143/84 (the term "OPI" as used herein means an "unexamined published application"). However, these combinations still fail to totally remove various disadvantages that only insufficient color forming properties are obtained; formed dyes have a so poor hue that the color reproduction is adversely affected; color balance of the remaining dye image is changed due to deterioration by, particularly, heat or light; and that cyan color is temporarily disappeared by light. As to the phenomenon of temporary disappearance of cyan color, an improvement of reversibly restoring the cyan color in a dark place is demanded.

Further, the techniques as disclosed in Japanese Patent Application (OPI) Nos. 229029/85 and 232550/85 concerned with a combination of specified cyan, magenta and yellow couplers are extremely improved in the above-described various properties as compared with those hitherto known. However, even in this case, though reproduction of primary colors such as red color and blue color is excellent, faithfulness in reproduction of intermediate colors such as fresh color and reddish purple color is insufficient for a potential reason that a spectral spectrum main absorption wavelength of magenta image is shifted to the long wavelength side. Also, when color images are preserved under severe conditions of high temperature and high humidity, they involve a drawback that gray-series colors are changed to a reddish color.

SUMMARY OF THE INVENTION

An object of the present invention is to simultaneously solve the above-described problems and, more specifically, to provide a multilayered silver halide color photographic material which has good color forming properties, forms a color photographic image with improved color reproducibility and improved image preservability, and which undergoes no change in color balance particularly when preserved in a dark or exposed to light for a long time. More particularly, it is to provide a multilayered silver halide color photographic material which faithfully reproduces intermediate colors and which forms color images with no change in color even when preserved under severe conditions of high temperature and high humidity.

The above object of the present invention can be attained by a silver halide color photographic material comprising a support having provided thereon a red-sensitive layer, a green-sensitive layer, and a blue-sensitive layer, in which at least one of couplers represented by the formulae (I) and/or (II), at least one of couplers represented by the following formula (III), and at least one of couplers represented by the following formula (IV) are respectively incorporated in the light-sensitive layers different from each other in color sensitivity:

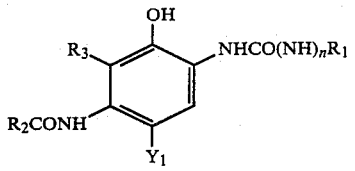

(I)

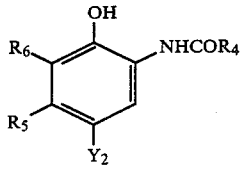

(II)

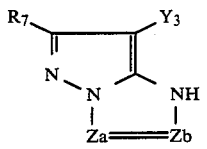

(III)

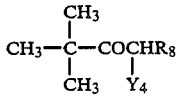

(IV)

wherein:

$R_1$, $R_2$, and $R_4$ each represents a substituted or unsubstituted aliphatic, aromatic or heterocyclic group;

$R_3$, $R_5$, and $R_6$ each represents a hydrogen atom, a halogen atom, an aliphatic group, an aromatic group, or an acylamino group or, when taken together, $R_3$ and $R_2$ represent non-metallic atoms necessary for forming a nitrogen-containing 5- or 6-membered ring;

$R_7$ represents a alkoxy group, an aryloxy group, or a heterocyclc oxy group;

$R_8$ represents a substituted or unsubstituted N-phenylcarbamoyl group;

Za and Zb each represents methine, substituted methine, or =N—;

$Y_1$, $Y_2$, $Y_3$ and $Y_4$ each represents a hydrogen atom or a group capable of being split off upon coupling reaction with an oxidation product of a developing agent; and n represents 0 or 1.

DETAILED DESCRIPTION OF THE INVENTION

In the formulae (I), (II), (III), and (IV), when $Y_1$, $Y_2$, $Y_3$, or $Y_4$ represents a coupling split-off group (hereinafter referred to as "split-off group"), the split-off group represents a group capable of connecting a coupling-active carbon atom to an aliphatic group, an aromatic group, a heterocyclic group, an aliphatic, aromatic, or heterocyclic sulfonyl group, or an aliphatic, aromatic, or heterocyclic carbonyl group via an oxygen atom, a nitrogen atom, a sulfur atom, or a carbon atom; a halogen atom; an aromatic azo group; and so on. The aliphatic, aromatic, or heterocyclic group contained in this split-off group may be substituted by one or more substituents acceptable for $R_1$ as described hereafter. When the two or more substituents are present, these substituents may be either the same or different. Further, the substituent or substituents may further be substituted by one or more substituents acceptable for $R_1$.

Specific examples of the coupling split-off group include a halogen atom (such as a fluorine atom, a chlorine atom, a bromine atom, etc.); an alkoxy group (such as an ethoxy group, a dodecyloxy group, a methoxyethylcarbamoylmethoxy group, a carboxylpropyloxy group, a methylsulfonylethoxy group, etc.); an aryloxy group (such as a 4-chlorophenoxy group, a 4-methoxyphenoxy group, a 4-carboxyphenoxy group, etc.); an acyloxy group (such as an acetoxy group, a tetradecanoyloxy group, a benzoyloxy group, etc.); an aliphatic or aromatic sulfonyloxy group (such as a methanesulfonyloxy group, a toluenesulfonyloxy group, etc.); an acylamino group (such as a dichloroacetylamino group, a heptafluorobutyrylamino group, etc.); an aliphatic or aromatic sulfonamido group (such as a methanesulfonamino group, a p-toluenesulfonylamino group, etc.); an alkoxycarbonyloxy group (such as an ethoxycarbonyloxy group, a benzyloxycarbonyloxy group, etc.); an aryloxycarbonyloxy group (such as a phenoxycarbonyloxy group, etc.); an aliphatic, aromatic, or heterocyclic thio group (such as an ethylthio group, a phenylthio group, a tetrazolylthio group, etc.); a carbamoylamino group (such as an N-methylcarbamoylamino group, an N-phenylcarbamoylamino group, etc.); a 5- or 6-membered nitrogen-containing heterocyclic group (such as an imidazolyl group, a pyrazolyl group, a triazolyl group, a tetrazolyl group, a 1,2-dihydro-2-oxo-1-pyridyl group, etc.); an imido group (such as a succinimido group, a hydantoinyl group, etc.); an aromatic azo group (such as a phenylazo group); and so on. These groups may be substituted by one or more substituents acceptable for $R_1$ as described hereafter. Examples of the split-off group bonded via an oxygen atom include bis-type couplers obtained by condensing four-equivalent couplers with aldehydes or ketones. The split-off group of the present invention may contain a photographically useful group such as a development inhibitor or a development accelerator. Preferred combinations of the split-off groups in the respective formulae (I), (II), (III), and (IV) are described hereinbelow.

The cyan couplers represented by the formulae (I) and (II) are described. With reference to the substituents $R_1$, $R_2$, and $R_4$, examples of the aliphatic group containing from 1 to 32 carbon atoms include a methyl group, a butyl group, a tridecyl group, a cyclohexyl group, an allyl group, etc.; examples of the aryl group include a phenyl group, a naphthyl group, etc.; and examples of the heterocyclic group include a 2-pyridyl group, a 2-imidazolyl group, a 2-furyl group, a 6-quinolyl group, etc. These groups may be substituted by one or more groups selected from an alkyl group, an aryl group, a heterocyclic group, an alkoxy group (e.g., a methoxy group, a 2-methoxyethoxy group, etc.), an aryloxy group (e.g., a 2,4-di-tert-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toleuensulfonyloxy group, etc.), an amido group (e.g., an acetylamino group, a methanesulfonamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxyl group, a cyano group, a carboxyl group, a nitro group, a sulfo group, and a halogen atom.

Where $R_3$ in the formula (I) or $R_6$ in the formula (II) presents a substituent which can be substituted, they may be substituted by one or more substituents described with respect to $R_1$.

$R_5$ in the formula (II) preferably represents an aliphatic group such as a methyl group; an ethyl group, a propyl group, a butyl group, a pentadecyl group, a tertbutyl group, a cyclohexyl group, a cyclohexylmethyl group, a phenylthiomethyl group, a dodecyloxyphenylthiomethyl group, a butanamidomethyl group, a methoxymethyl group, or the like.

$Y_1$ and $Y_2$ in the formulae (I) and (II) each represents a hydrogen atom or a coupling split-off group (including a coupling split-off atom; hereinafter the same). Examples include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic, or heterocyclic thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), and the like. These split-off groups may contain a photographically useful group.

Preferable examples of cyan couplers represented by the foregoing formula (I) or (II) are as described below.

$R_1$ in the formula (I) preferably represents an aryl group or a heterocyclic group and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, an oxycarbonyl group, or a cyano group.

When $R_3$ and $R_2$ in the formula (I) do not jointly form a ring, $R_2$ preferably represents a substituted or unsubstituted alkyl or aryl group and particularly preferably a substituted aryloxy-substituted alkyl group; and $R_3$ preferably represents a hydrogen atom.

$R_4$ in the formula (II) preferably represents a substituted or unsubstituted alkyl or aryl group and particularly preferably a substituted aryloxy-substituted alkyl group.

$R_5$ in the formula (II) preferably represents an alkyl group containing from 2 to 15 carbon atoms or a methyl group having a substituent containing 1 or more carbon atoms. As the substituent, an arylthio group, an alkylthio group, an acylamino group, an aryloxy group, and an alkyloxy group are preferable.

$R_5$ in the formula (II) more preferably represents an alkyl group containing from 2 to 15 carbon atoms and particularly preferably an alkyl group containing from 2 to 4 carbon atoms.

$R_6$ in the formula (II) preferably represents a hydrogen atom or a halogen atom and particularly preferably a chlorine atom or a fluorine atom.

$Y_1$ and $Y_2$ in the formulae (I) and (II) preferably each represents a hydrogen atom, a halogen atom, an alkoxy group, an aryloxy group, an acyloxy group, or a sulfonamido group.

$Y_2$ in the formula (II) preferably represents a halogen atom and particularly preferably a chlorine atom or a fluorine atom.

When n in the formula (I) represents O, $Y_1$ more preferably represents a halogen atom and particularly preferably a chlorine atom or a fluorine atom.

Next, the substituents in the formula (III) are described. $R_7$represents an alkoxy group, an aryloxy group, or a heterocyclic oxy group. In more detail, $R_7$ represents an alkoxy group such as a methoxy group, an ethoxy group, an isopropoxy group, a hexyloxy group, a t-butoxy group, a dodecyloxy group, a 2-ethylhexyloxy group, a benzyloxy group, a cyclohexloxy group, a 2-chloroethoxy group, a 2-phenoxyethoxy group, a 2-(2,4-dichlorophenoxy)ethoxy group, an allyloxy group, etc.; an aryloxy group such as a phenoxy group, a 2,4-dichlorophenoxy group, a 4-methylphenoxy group, a 4-nonylphenoxy group, a 3-pentadecylphenoxy group, a 3-butanamidophenoxy group, a 2-naphthoxy group, a 1-naphthoxy group, a 4-methoxyphenoxy group, a 3,5-dimethoxyphenoxy group, a 3-cyanophenoxy group, etc.; or a heterocylic oxy group such as a pyridyloxy group, a 2-thienyloxy group, a 2-methyltetrazol-5-oxy group, a 2-benzothiazoloxy group, a 2-pyrimidinoxy group, etc.

$Y_3$ in the formula (III) represents a hydrogen atom or a coupling split-off group. Examples of the coupling split-off group include a halogen atom (e.g., a fluorine atom, a chlorine atom, etc.), an alkoxy group (e.g., a methoxy group, an ethoxy group, a dodecyloxy group, a methoxyethylcarbamoylmethoxy group, a methylsulfonylethoxy group, etc.), an aryloxy group (e.g., a phenoxy group, a 4-methylphenoxy group, a 4-methoxyphenoxy group, a 4-t-butylphenoxy group, a 4-carboethoxyphenoxy group, a 4-cyanophenoxy group, a 2,4-dichlorophenoxy group, etc.), an acyloxy group (e.g., an acetoxy group, a tetradecanoyloxy group, etc.), an amido group (e.g., a dichloroacetamido group, a benzenesulfonylamino group, a trifluoroacetamido group, etc.), an imido group (e.g., a succinimido group, a phthalimido group, a 5,5-dimethyl-2,4-dioxooxazolidinyl group, a 1-benzyl-5-ethoxyhydantoinyl group, etc.), a nitrogen-containing heterocyclic group (e.g., a pyrazole group, a 4-chloropyrazole group, a 3,5-dimethyl-1,2,4-triazol-2-yl group, an imidazolyl group, a 3-chloro-1,2,4-triazol-2-yl group, etc.), an alkylthio group (e.g., an ethylthio group, a dodecylthio group, a 1-ethoxycarbonyldodecylthio group, a 3-phenoxypropylthio group, a 2-(2,4-di-tert-amylphenoxy)ethylthio group, etc.), an arylthio group (e.g., a phenylthio group, a 2-butoxy-5-tert-octylphenylthio group, a 4-dodecyloxyphenylthio group, a 2-(2-ethoxyethoxy)-5-tert-octylphenylthio group, a 3-pentadecylphenylthio group, a 3-octyloxyphenylthio group, a 3-(N,N-didodecylcarbamoyl)phenylthio group, a 2-octyloxo-5-chlorophenylthio group, etc.), a heterocyclic thio group (e.g., a 1-phenyltetrazol-5-thio group, a 1-ethyltetrazol-5-thio group, a 1-dodecyl-1,2,4-triazol-5-thio group, etc.), etc. Of these coupling splitoff groups, those which are split off at a mercapto group are preferable, with an arylthio group being particularly preferable.

Za and Zb in the formula (III) each represents a methine group, a substituted methine group, or an —N= group. Of the magenta couplers represented by the formula (III), those couplers which are represented by the following formulae (III-1) to (III-4) are particularly preferable:

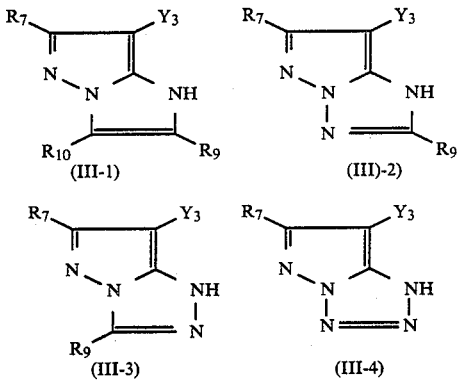

Of these, couplers (III-2) and (III-3) are particularly preferable, with couplers (III-2) being more preferable.

$R_9$ and $R_{10}$ in the formulae (III-1) to (III-4), which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group. $R_9$, $R_{10}$, or $Y_3$ may be a divalent group to form a bis-compound.

More specifically, $R_9$ and $R_{10}$ each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, an allyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)butylamido group, a γ-(3-t-butyl-4-hydroxyphenoxy)butylamido group, an α-{4-(4-hydroxyphenylsulfonyl)phenoxy)decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-{α-(3-t-butyl-4-hydroxyphenoxy)dodecanamido}anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), a carbamoylamino group (e.g., an N-ethylcarbamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-tert-amylphenoxy)propyl}-carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), or an aryloxycarbonyl group (e.g., a phenyloxycarbonyl group, a 3-pentadecylphenyloxycarbonyl group, etc.).

As the substituent of the phenyl group of N-phenylcarbamoyl group represented by $R_8$ in the formula (IV), any of those acceptable for $R_1$ may be selected and, where two or more substituents exist, they may be the same or different.

Preferable examples of $R_8$ are those represented by the following formula (IVA):

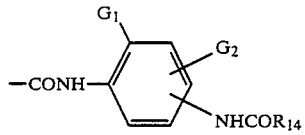

(IVA)

wherein $G_1$ represents a halogen atom or an alkoxy group; $G_2$ represents a hydrogen atom, a halogen atom, or an optionally substituted alkoxy group; and $R_{14}$ represents an optionally substituted alkyl group.

As the substituents for $G_2$ and $R_{14}$ in the formula (IVA), there are illustrated an alkyl group, an alkoxy group, an aryl group, an aryloxy group, an amino group, a dialkylamino group, a heterocyclic group (e.g., an N-morpholino group, an N-piperidino group, a 2-furyl group, etc.), a halogen atom, a nitro group, a hydroxyl group, a carboxyl group, a sulfo group, an alkoxycarbonyl group, etc.

Preferable split-off groups represented by $Y_4$ include those groups represented by the following formulae (X) to (XIII):

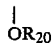

(X)

wherein $R_{20}$ represents an optionally substituted aryl or heterocyclic group;

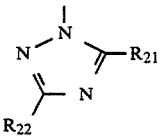

(XI)

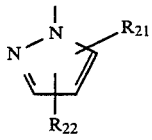

(XII)

wherein $R_{21}$ and $R_{22}$, which may be the same or different, each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl or heterocyclic group:

(XIII)

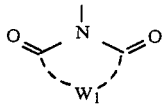

wherein $W_1$ represents a non-metallic atom necessary for forming a 4-, 5-, or 6-membered ring together with

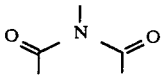

in the formula.

Of the groups represented by the formula (VIII), those represented by (XIV) to (XVI) are preferable:

(XIV)

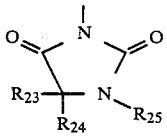

(XV)

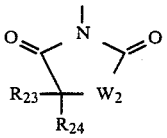

(XVI)

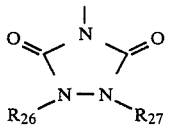

wherein $R_{23}$ and $R_{24}$ each represents a hydrogen atom, an alkyl group, an aryl group, an alkoxy group, an aryloxy group, or a hydroxyl group; $R_{25}$, $R_{26}$, and $R_{27}$ each represents a hydrogen atom, an alkyl group, an aryl group, an aralkyl group, or an acyl group; and $W_2$ represents an oxygen atom or a sulfur atom.

Specific examples of the couplers of the present invention represented by the formulae (I) to (IV) are shown below, which, however, are not limitative at all.

(I-1)

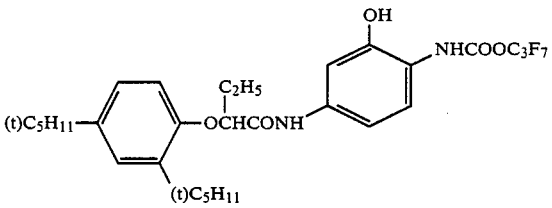

-continued
(I-2)
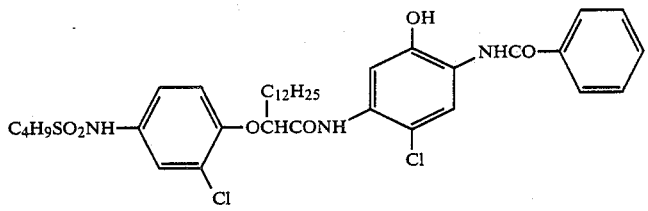
(I-3)
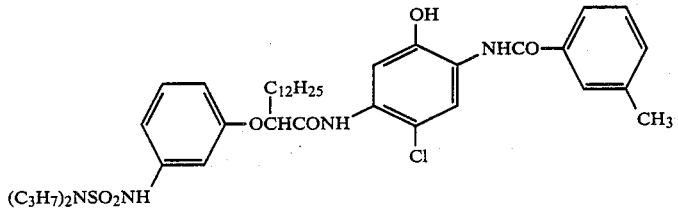
(I-4)
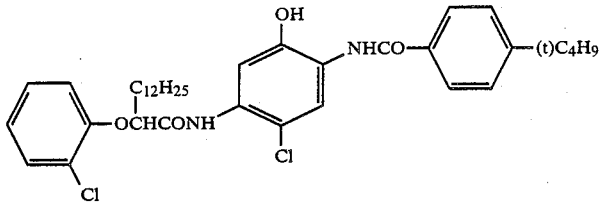
(I-5)
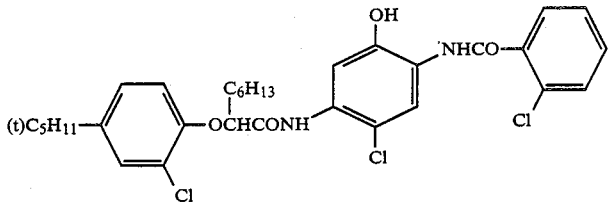
(I-6)
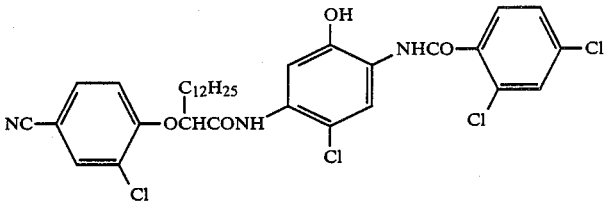
(I-7)
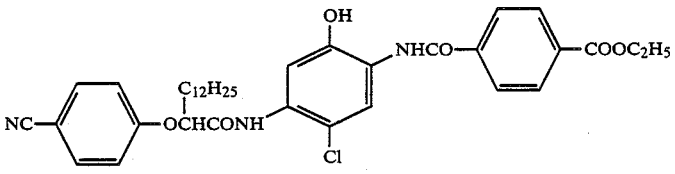
(I-8)
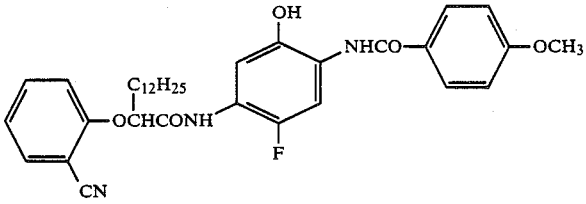

-continued
(I-9)
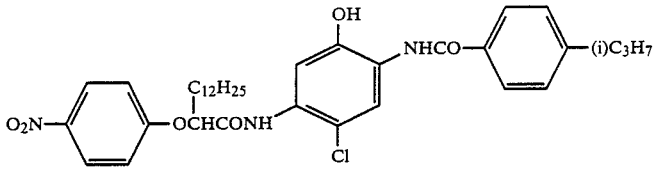
(I-10)
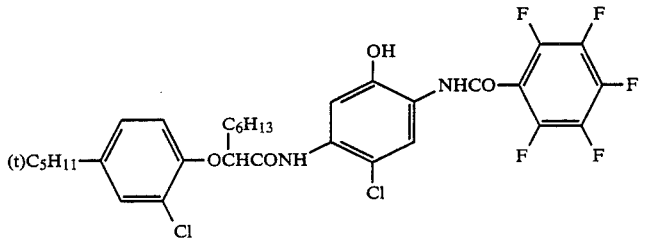
(I-11)
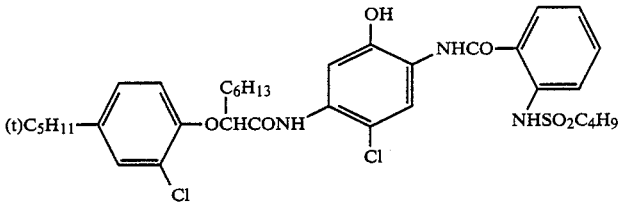
(I-12)
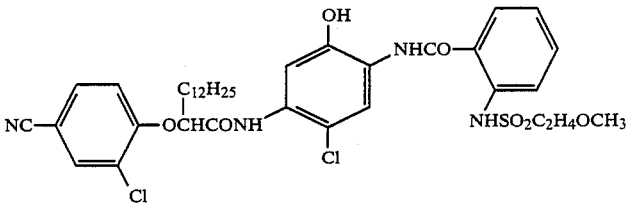
(I-13)
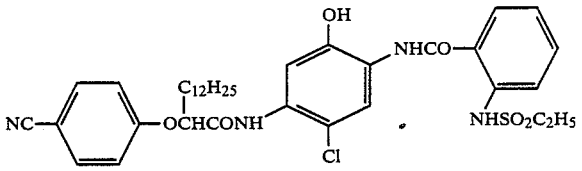
(I-14)
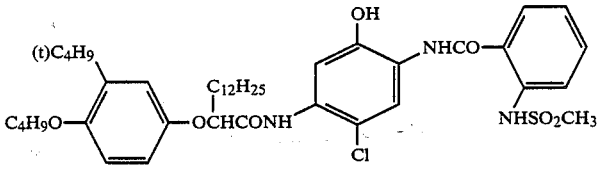
(I-15)
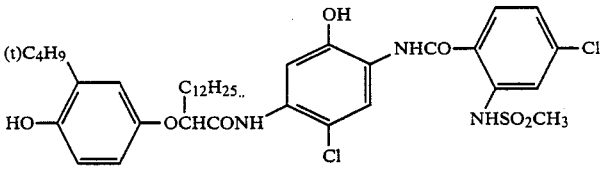

-continued
(I-16)
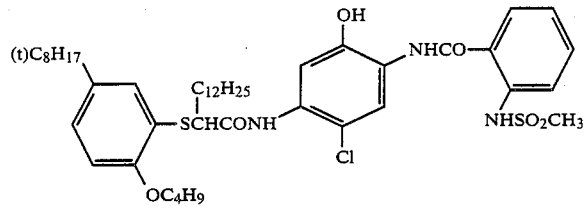
(I-17)
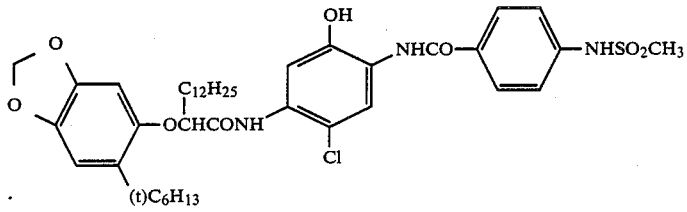
(I-18)
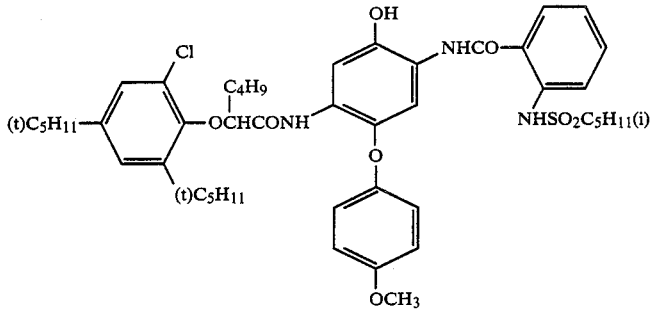
(I-19)
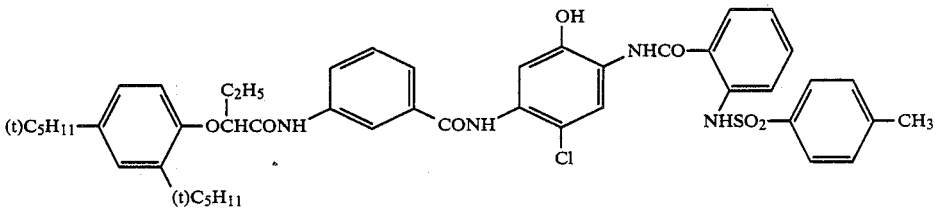
(I-20)
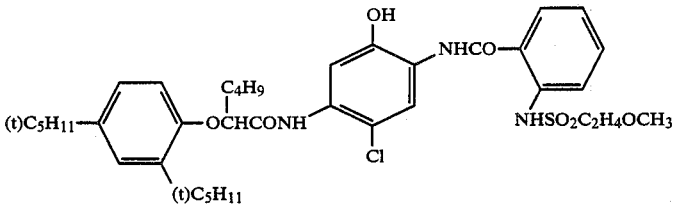
(I-21)
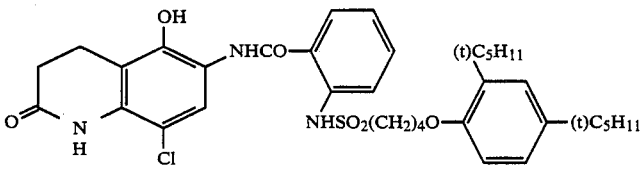
(I-22)
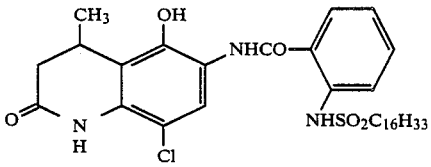

-continued
(I-23)
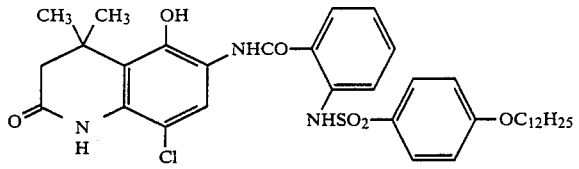
(I-24)
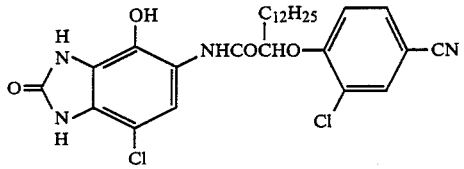
(I-25)
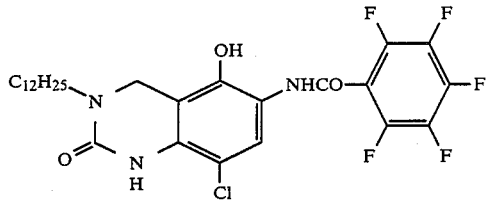
(I-26)
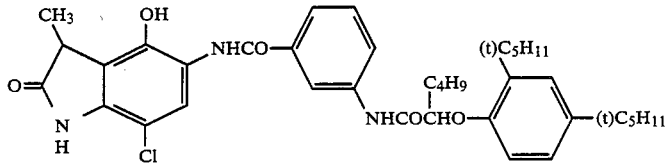
(I-27)
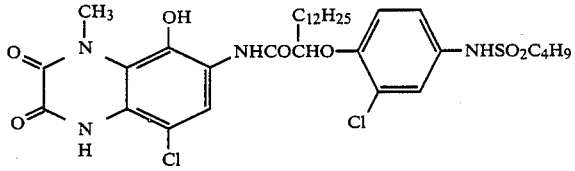
(I-28)
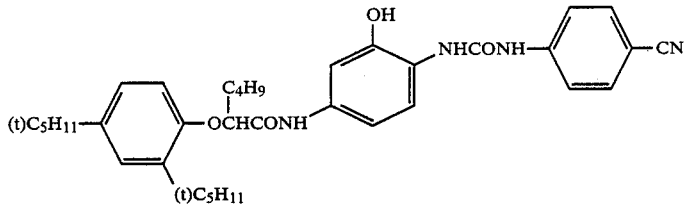
(I-29)
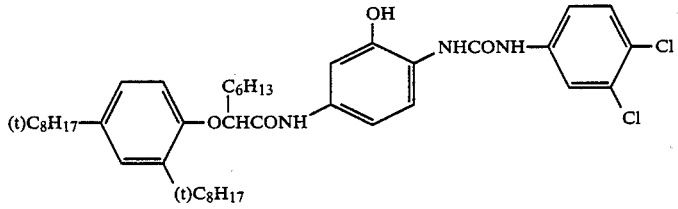
(I-30)
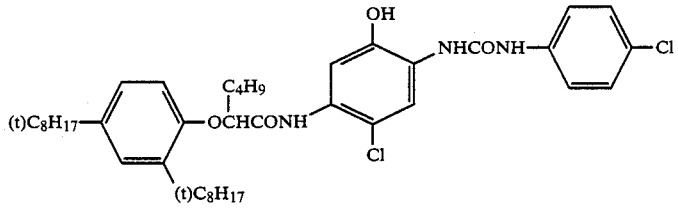

-continued
(I-31)
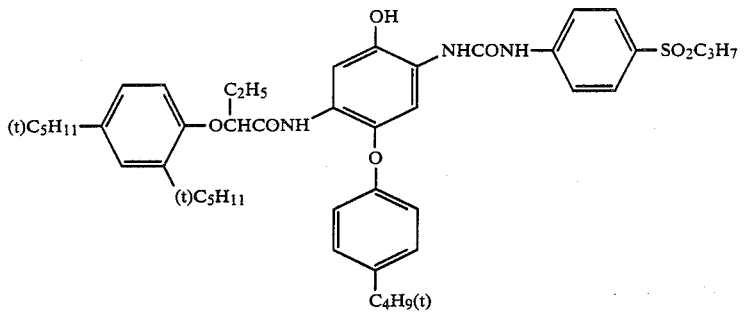
(I-32)
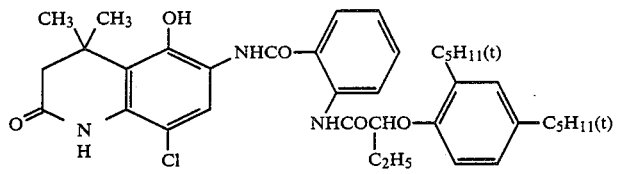
(I-33)
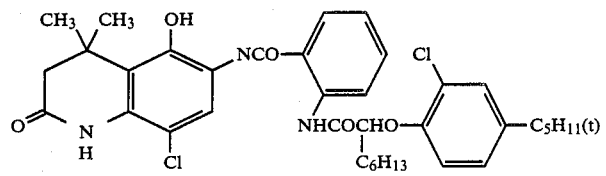
(I-34)
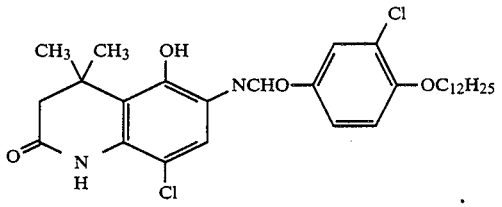
(I-35)
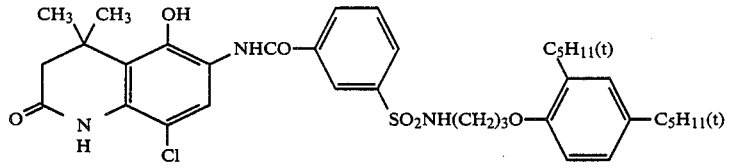
(I-36)
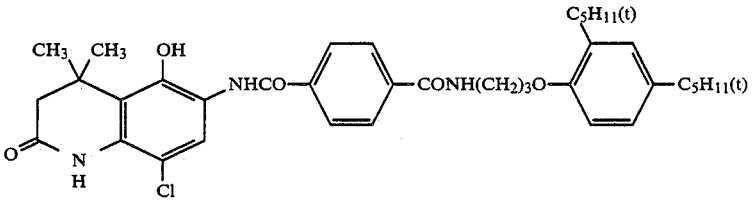
(I-37)
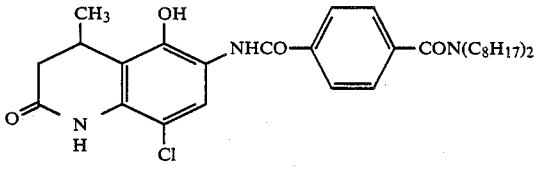

-continued
(I-38)
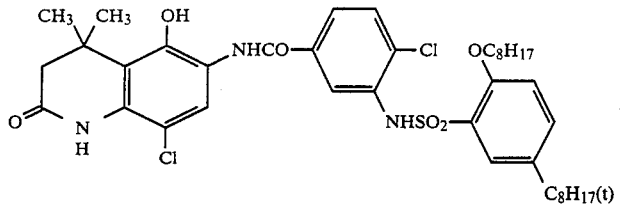
(I-39)
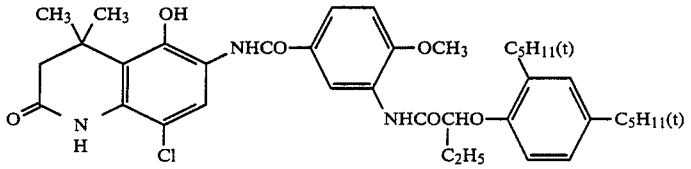
(I-40)
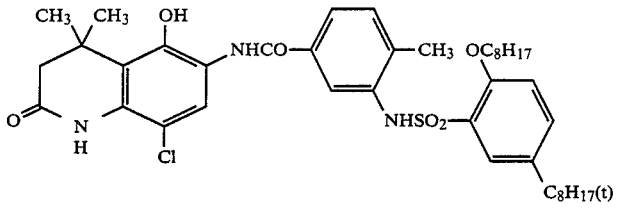
(I-41)
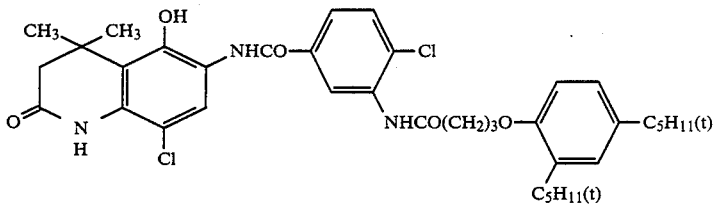
(I-42)
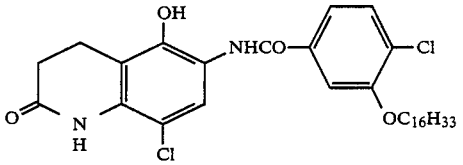
(I-43)
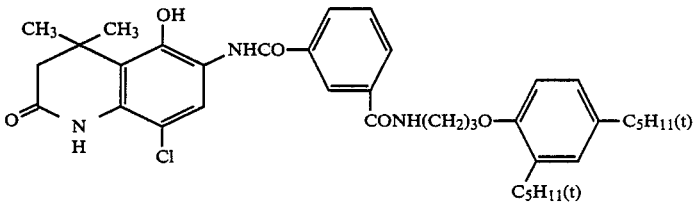
(I-44)
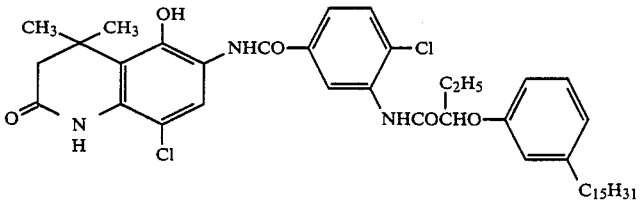

-continued
(I-45)
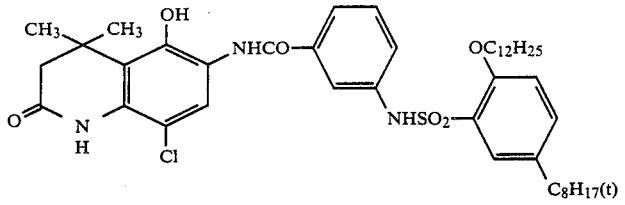
(I-46)
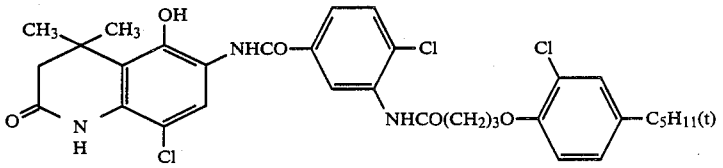
(II-1)
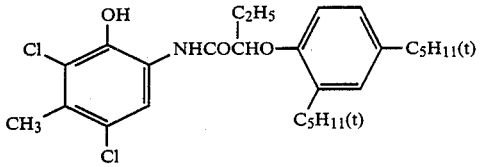
(II-2)
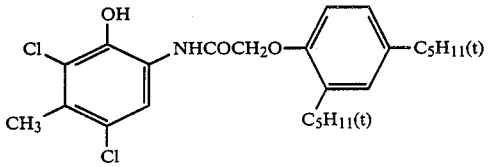
(II-3)
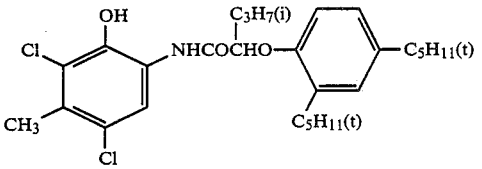
(II-4)
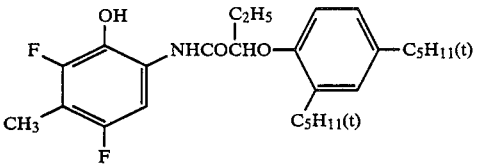
(II-5)
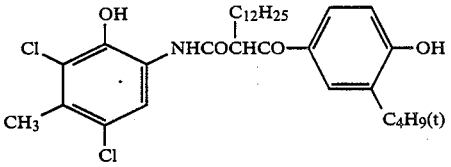
(II-6)
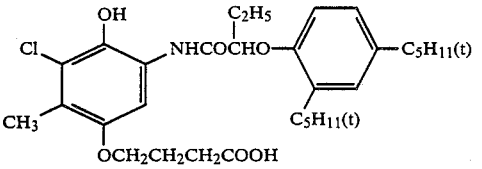

-continued
(II-7)
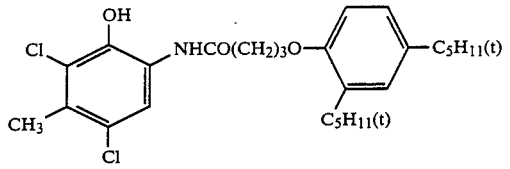
(II-8)
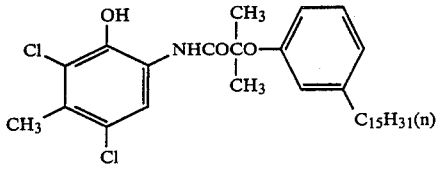
(II-9)
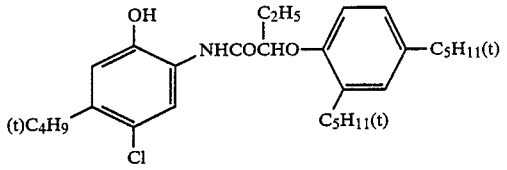
(II-10)
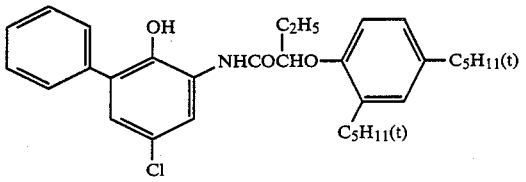
(II-11)
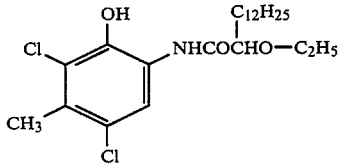
(II-12)
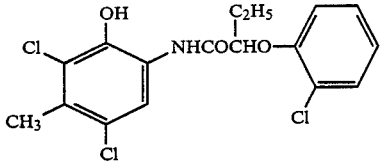
(II-13)
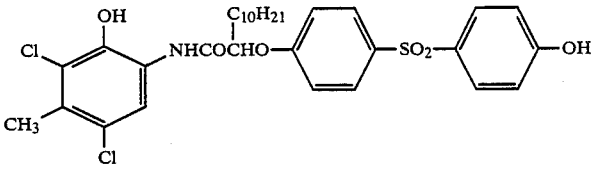
(II-14)
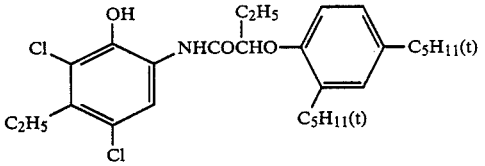

-continued
(II-15)
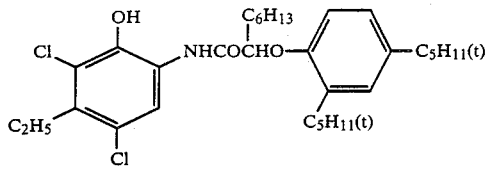
(II-16)
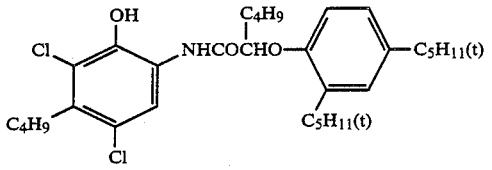
(II-17)
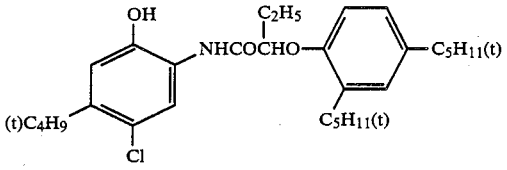
(II-18)
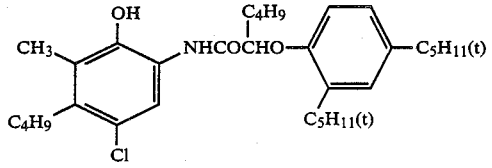
(II-19)
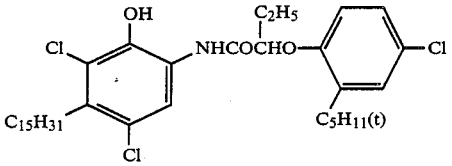
(II-20)
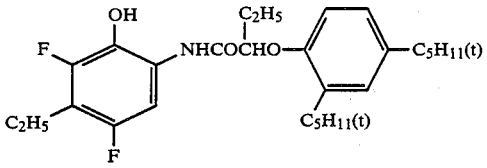
(II-21)
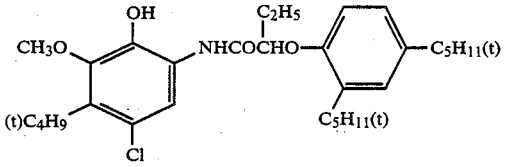
(II-22)
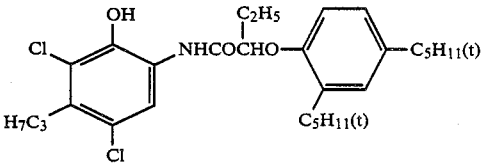

-continued
(II-23)
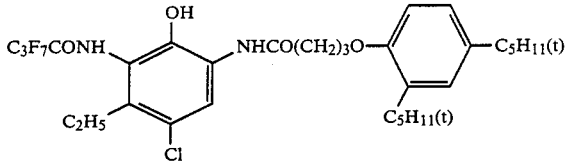
(II-24)
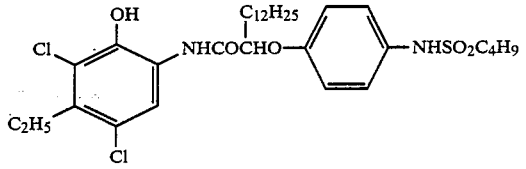
(II-25)
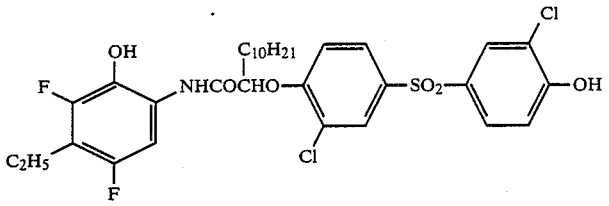
(II-26)
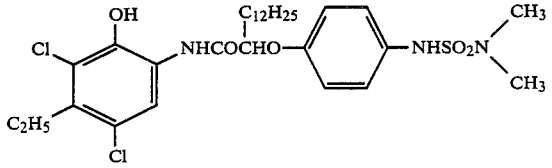
(II-27)
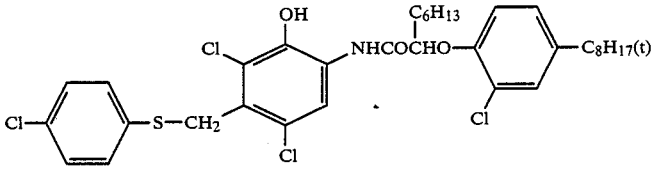
(II-28)
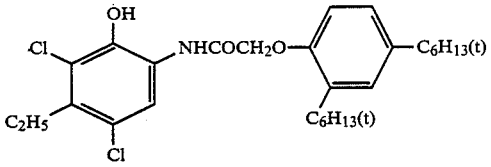
(II-29)
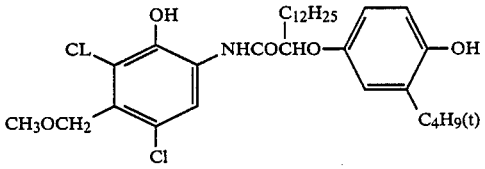
(II-30)
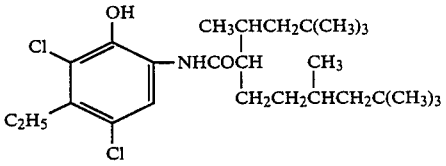

-continued
(II-31)
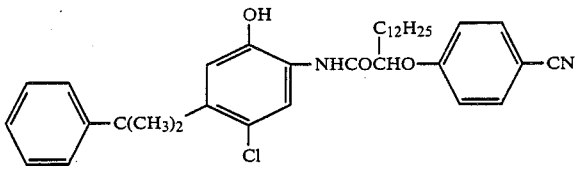
(II-32)
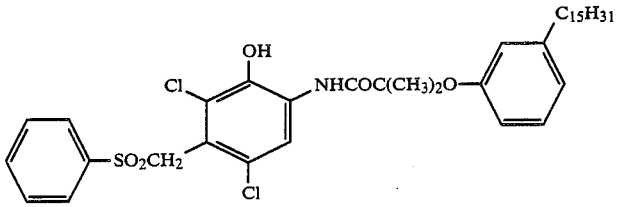
(II-33)
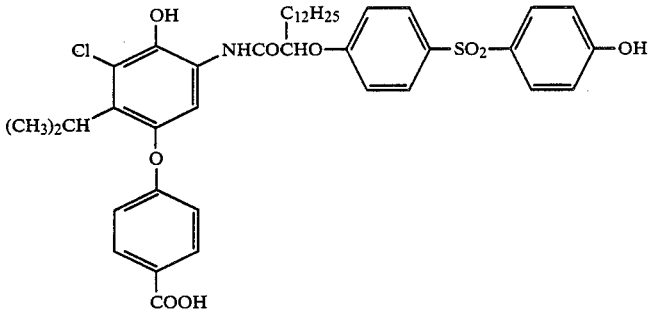
(III-1)
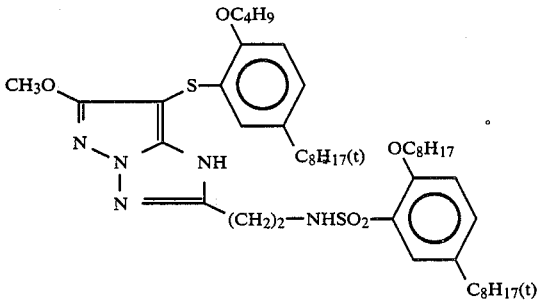
(III-2)
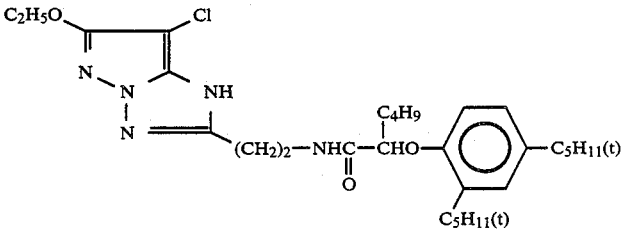
(III-3)
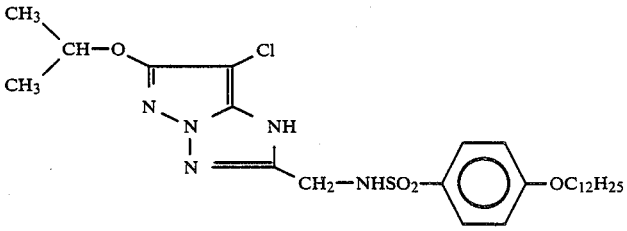

-continued
(III-4)
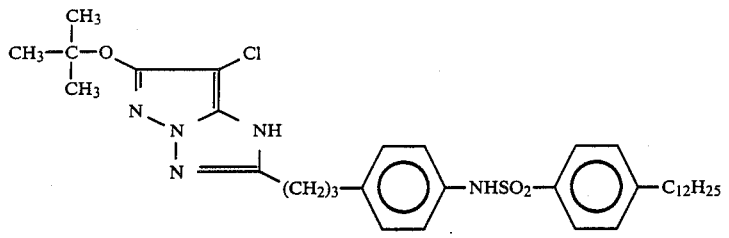
(III-5)
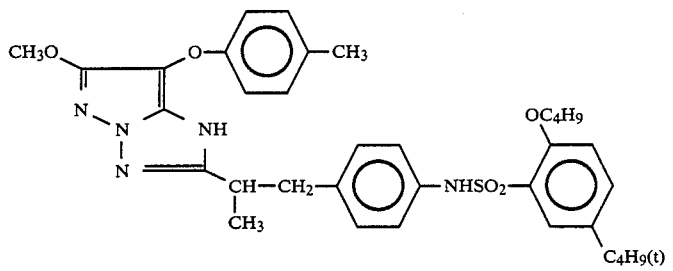
(III-6)
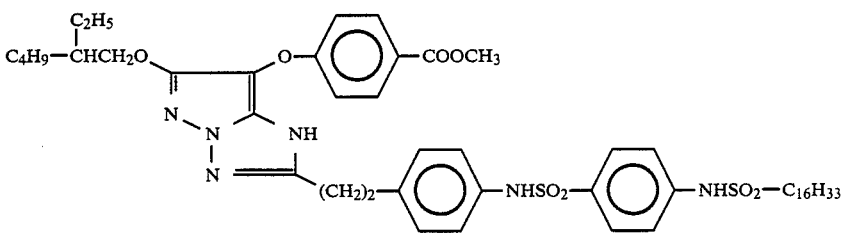
(III-7)
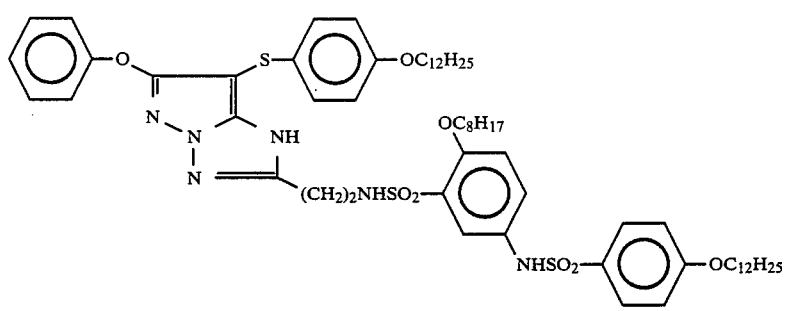
(III-8)
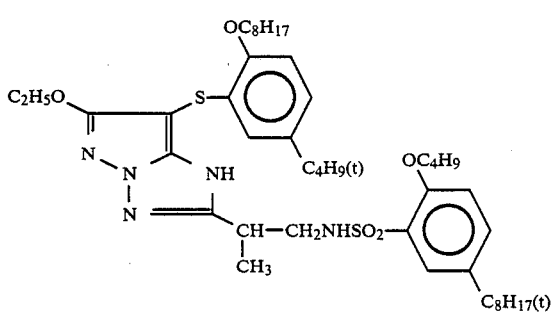

-continued
(III-9)
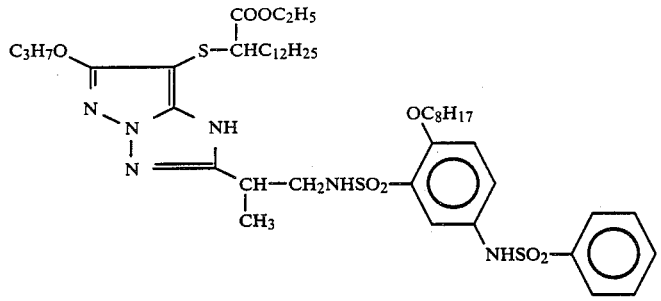
(III-10)
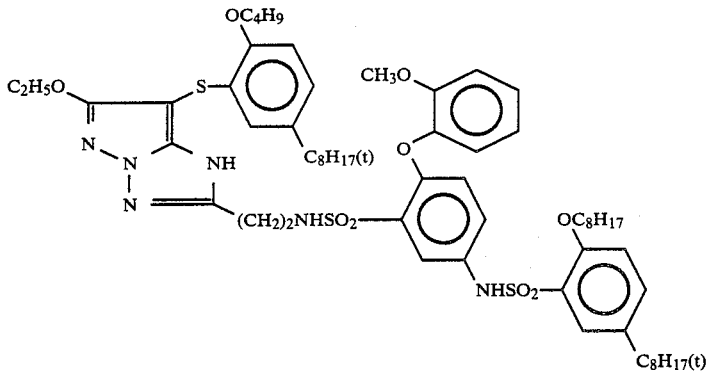
(III-11)
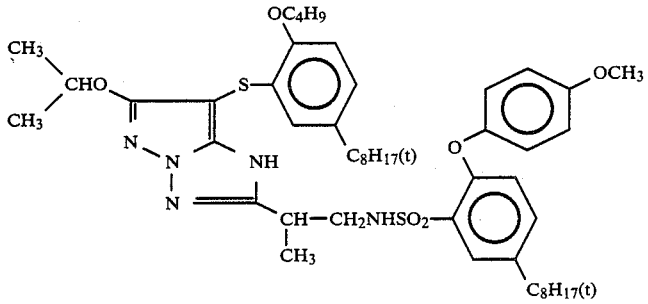
(III-12)
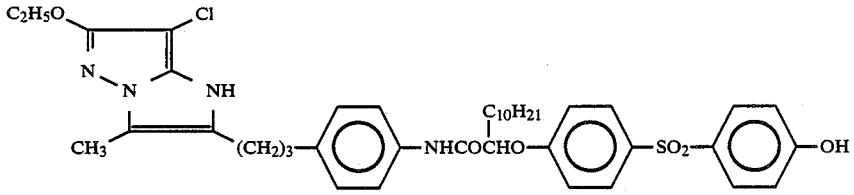
(III-13)
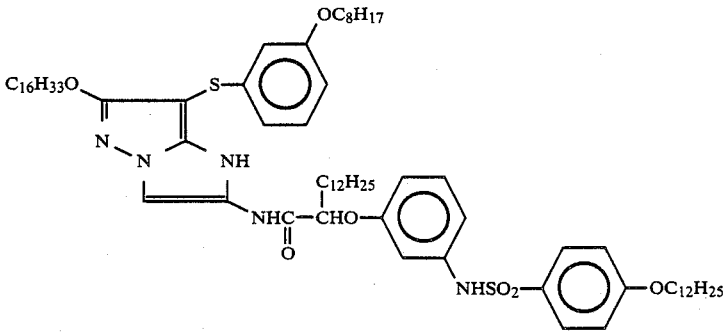

-continued
(III-14)
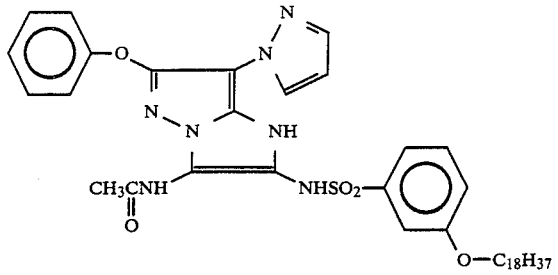
(III-15)
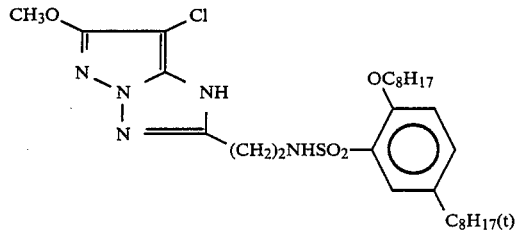
(III-16)
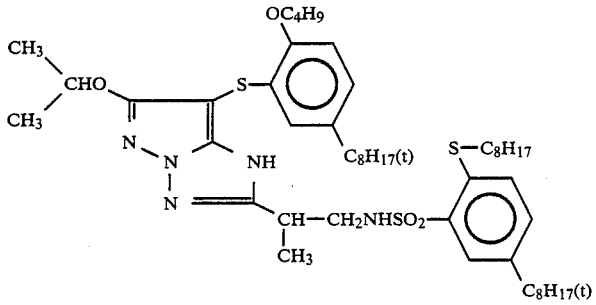
(III-17)
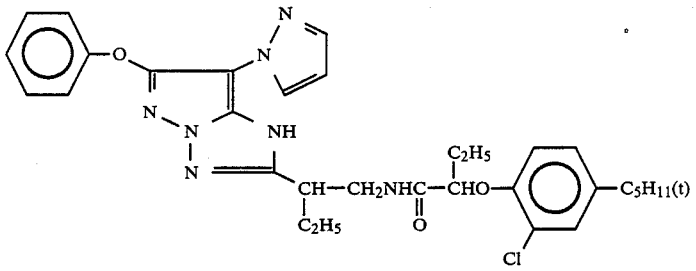
(III-18)
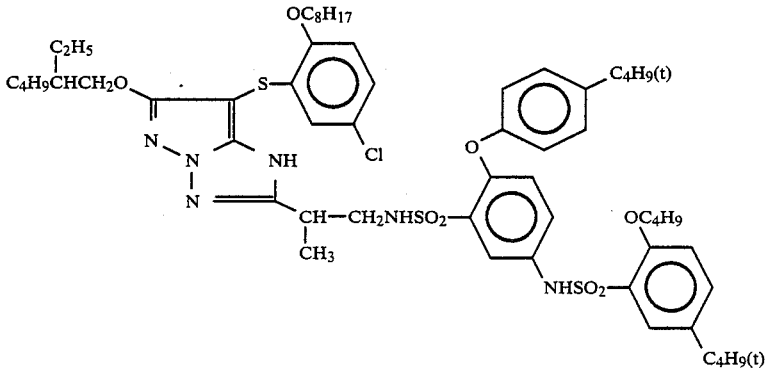

-continued
(III-19)
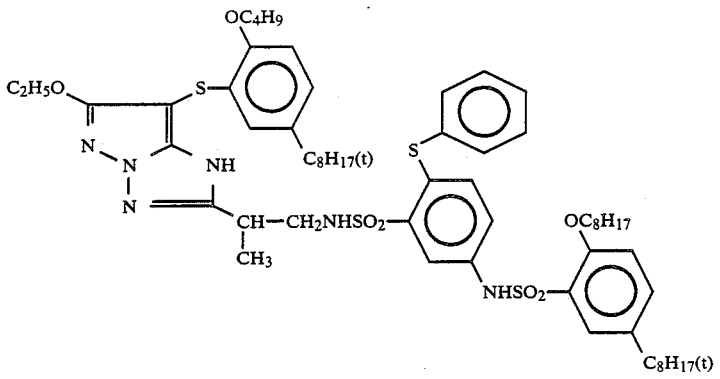
(III-20)
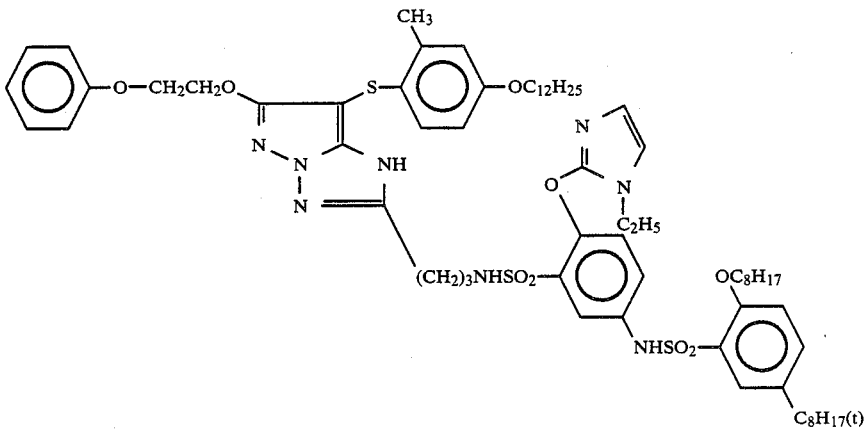
(III-21)
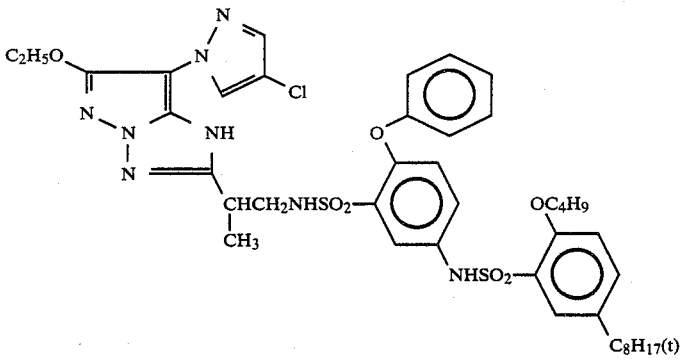
(III-22)
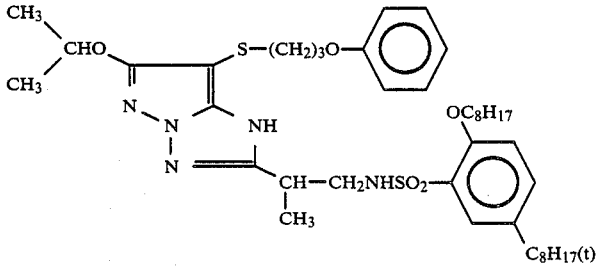

-continued
(III-23)
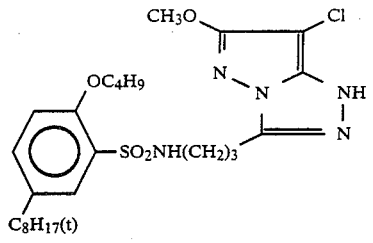
(III-24)
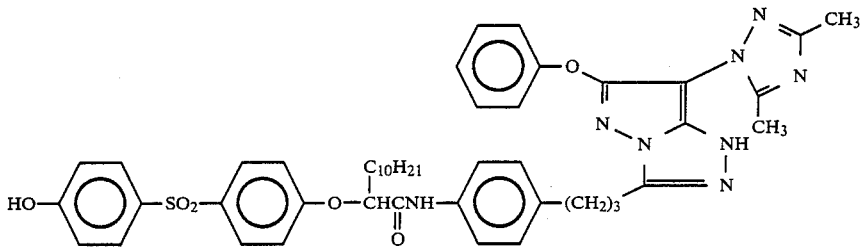
(III-25)
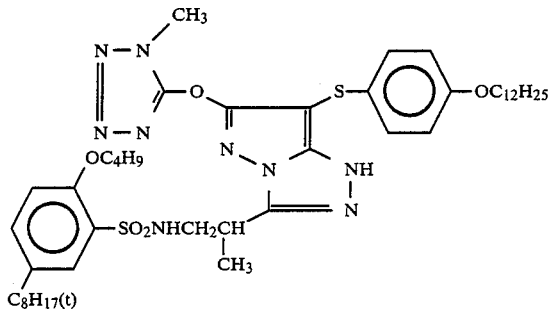
(III-26)
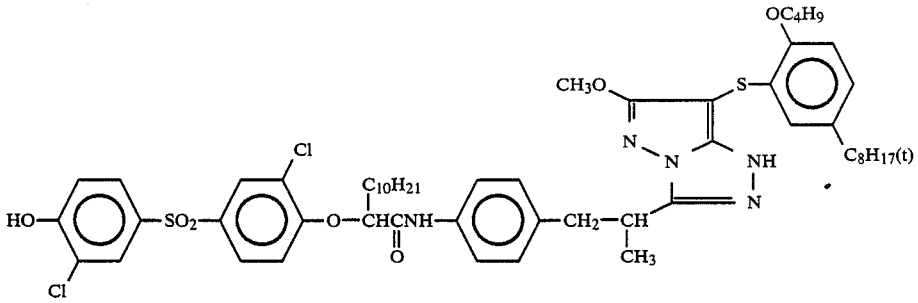
(III-27)
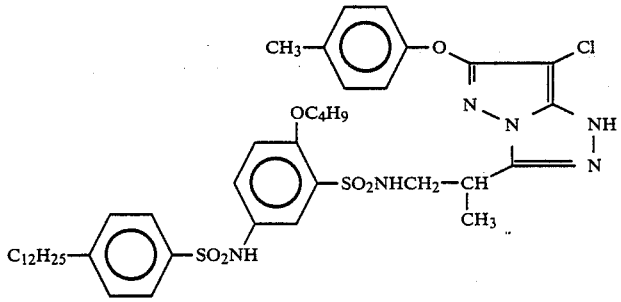

-continued
(III-28)
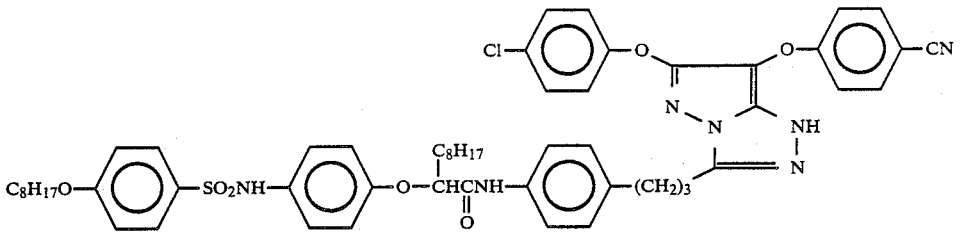
(III-29)
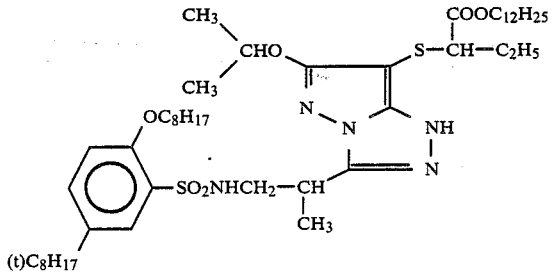
(III-30)
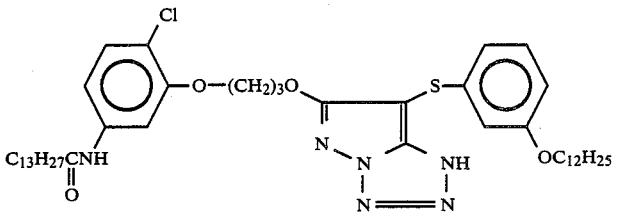
(III-31)
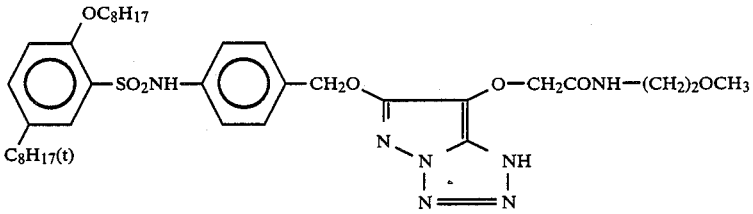
(III-32)
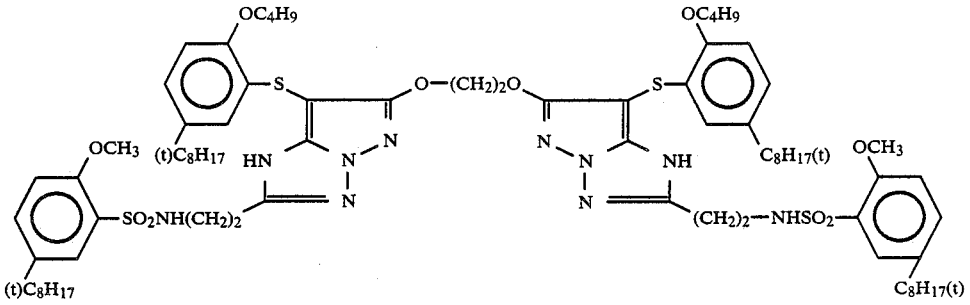
(IV-1)
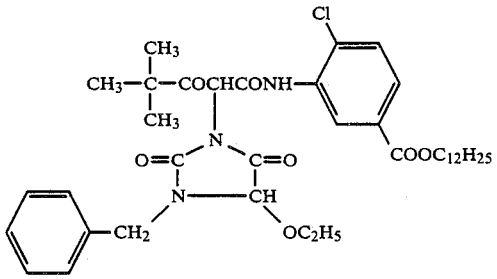

-continued
(IV-2)
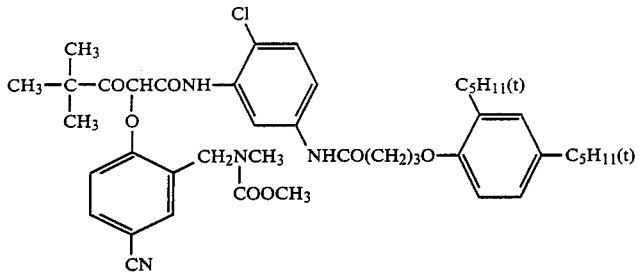
(IV-3)
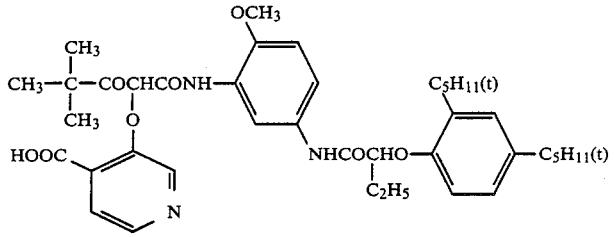
(IV-4)
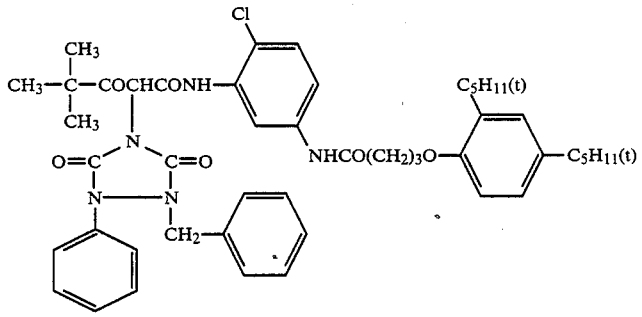
(IV-5)
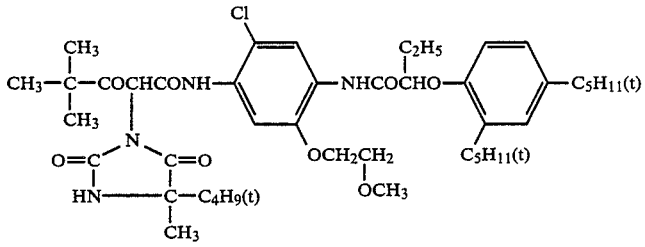
(IV-6)
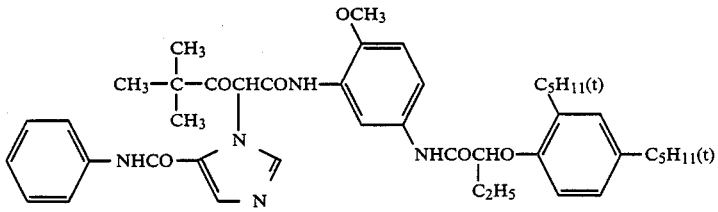

-continued
(IV-7)
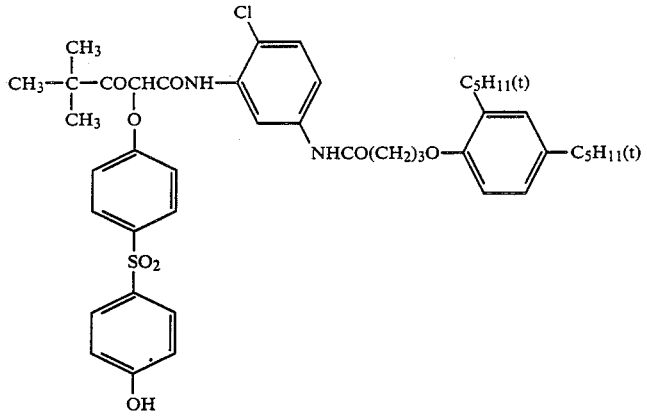
(IV-8)
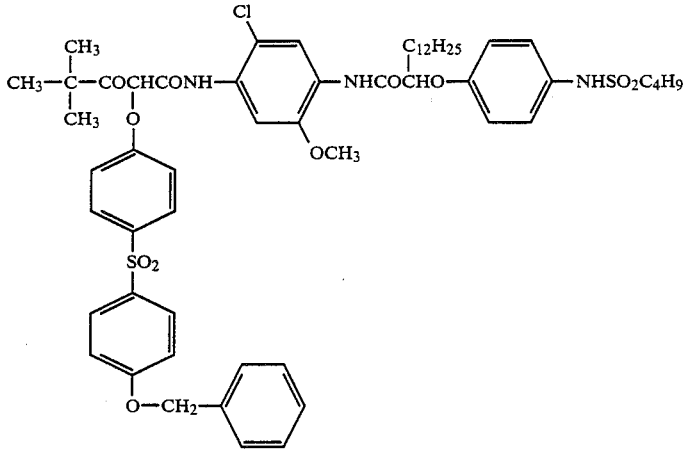
(IV-9)
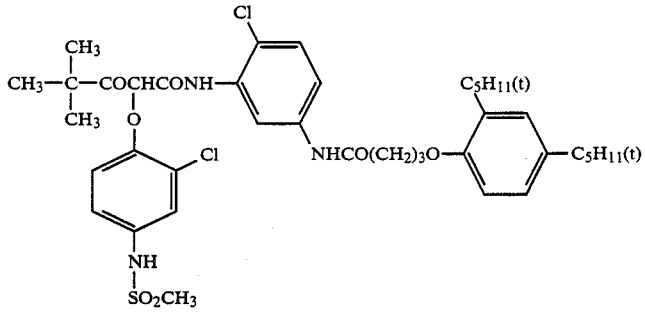
(IV-10)
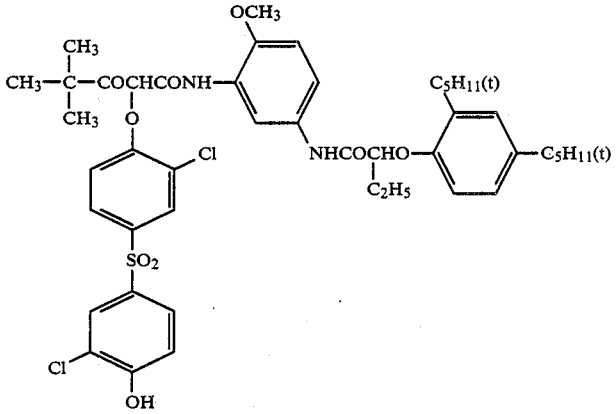

-continued
(IV-11)
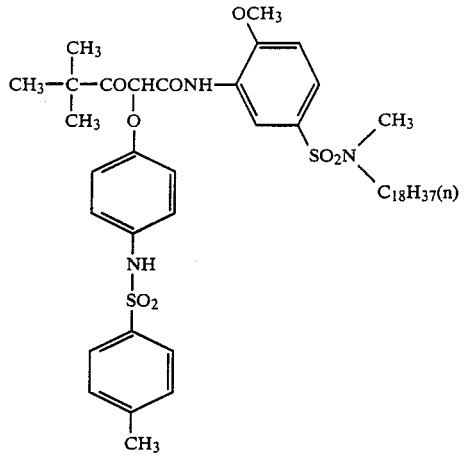
(IV-12)
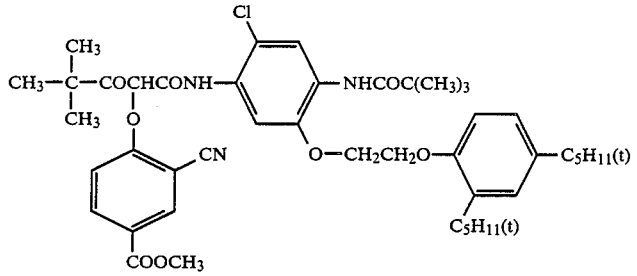
(IV-13)
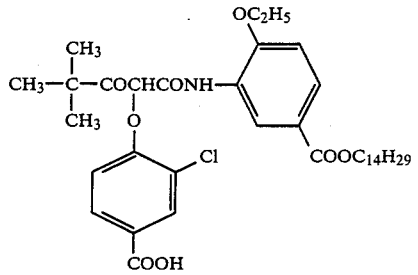
(IV-14)
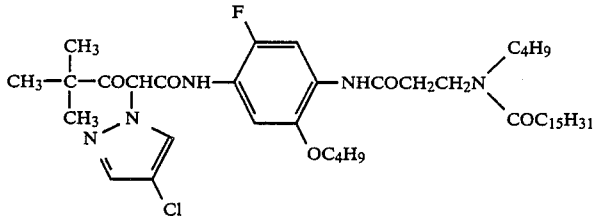
(IV-15)
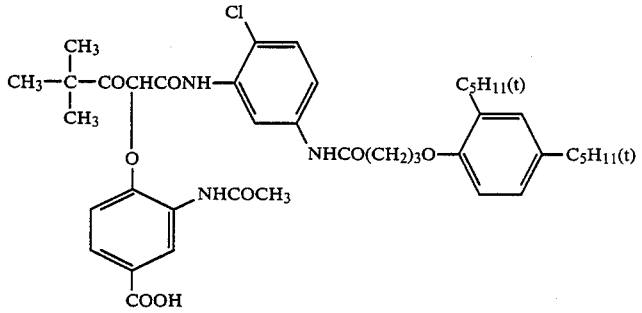

-continued
(IV-16)
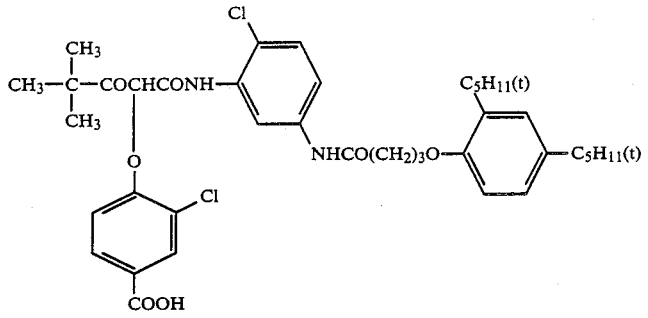
(IV-17)
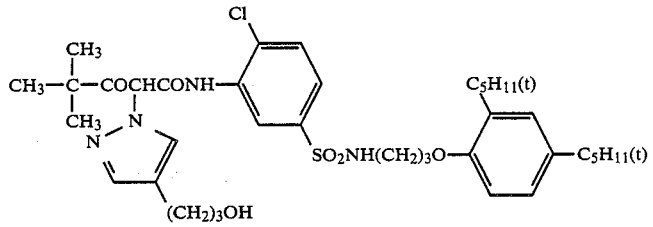
(IV-18)
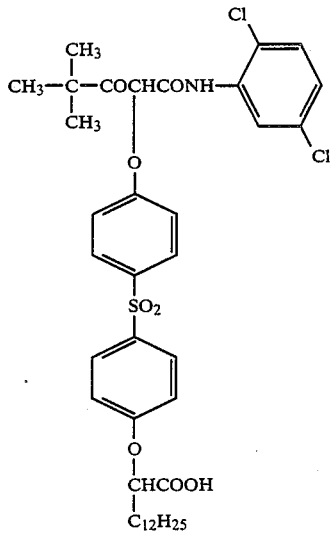
(IV-19)
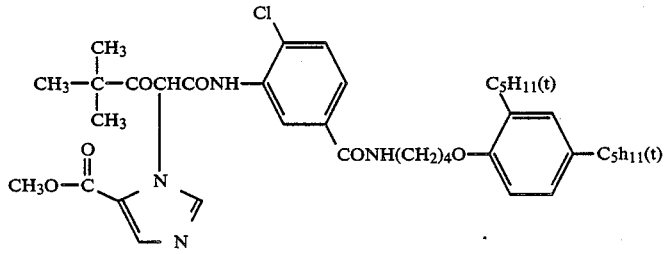
(IV-20)
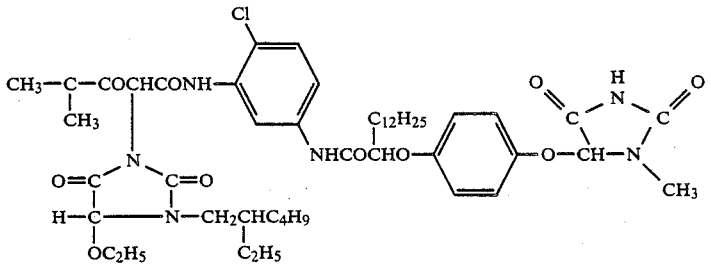

-continued
(IV-21)
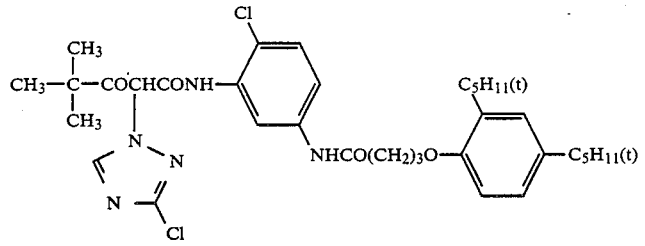
(IV-22)
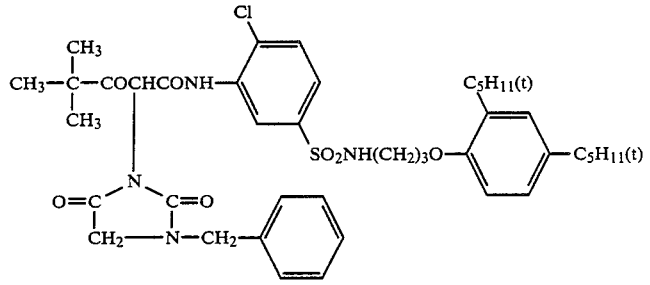
(IV-23)
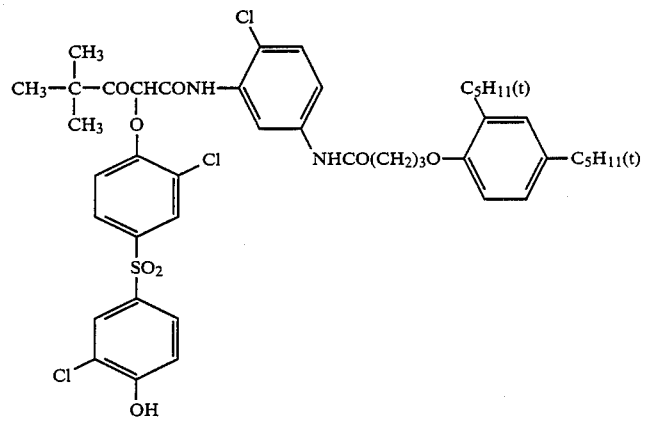
(IV-24)
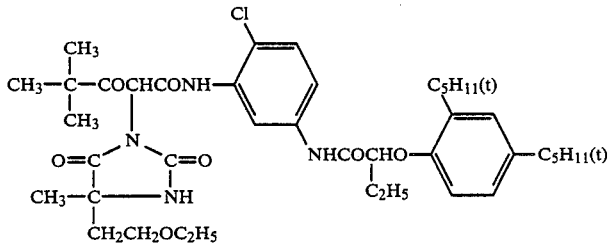
(IV-25)
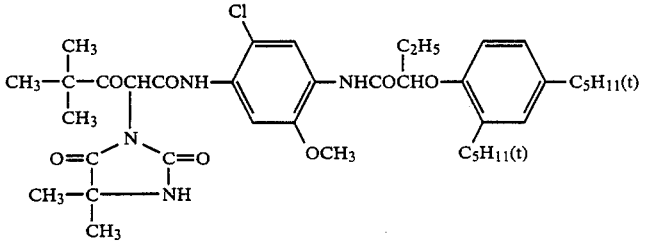

-continued
(IV-26)
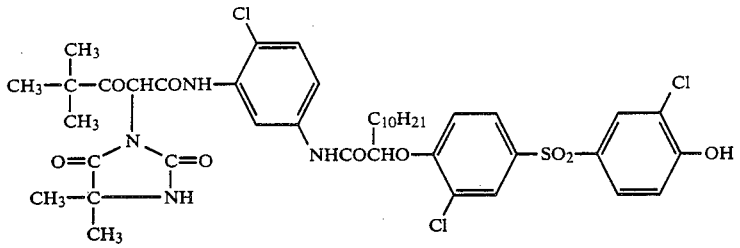
(IV-27)
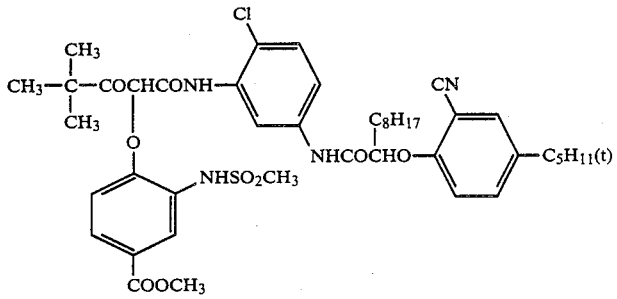
(IV-28)
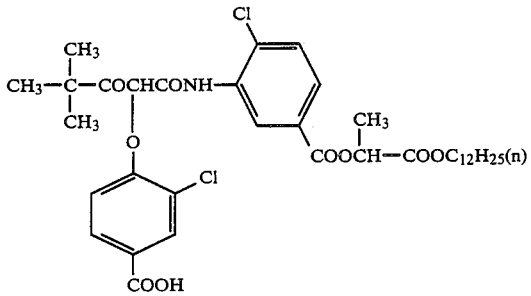
(IV-29)
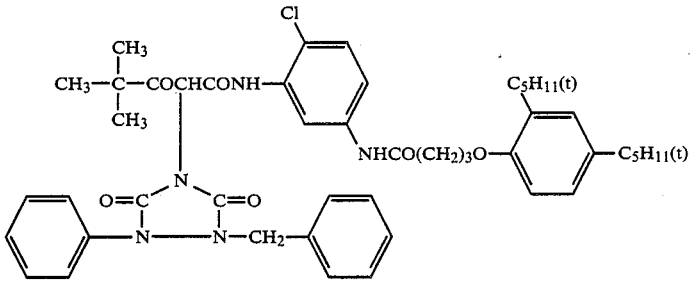
(IV-30)
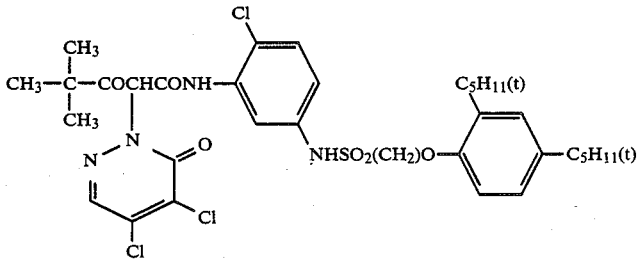
(IV-31)
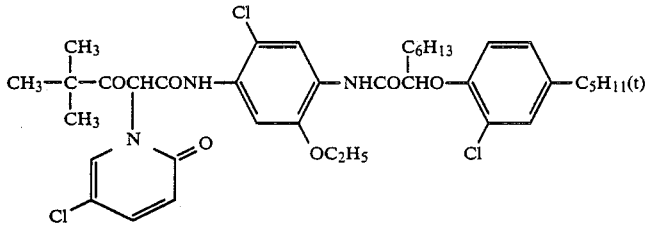

-continued
(IV-32)
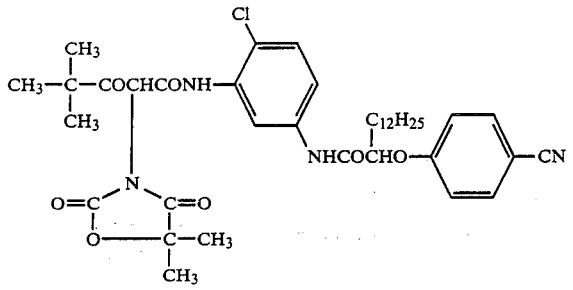
(IV-33)
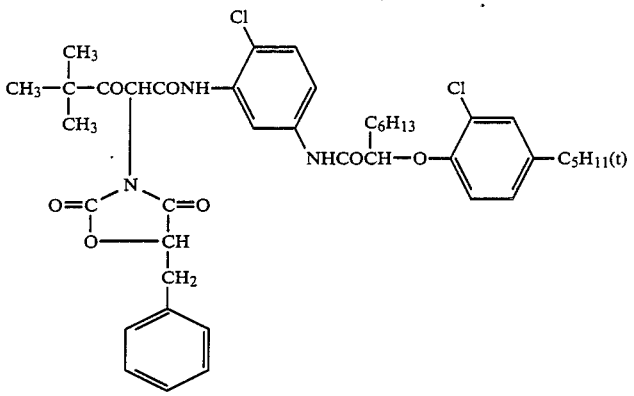
(IV-34)
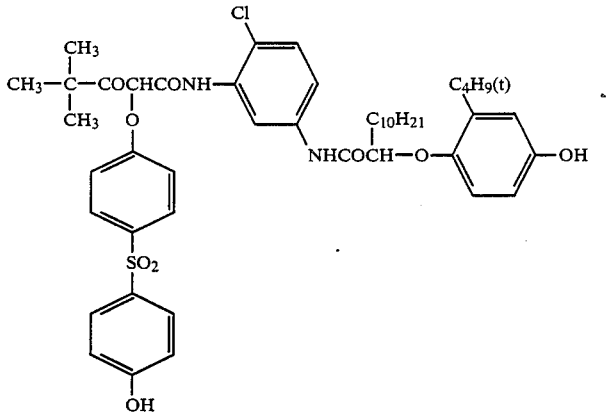
(IV-35)
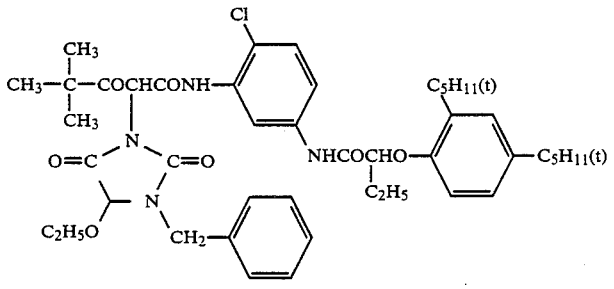

-continued (IV-36)

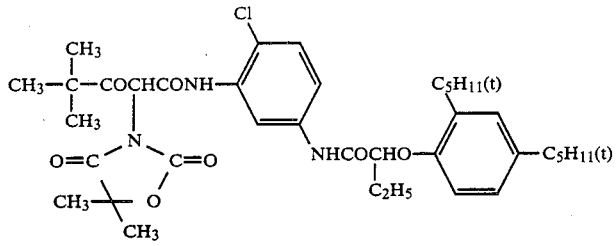

(IV-37)

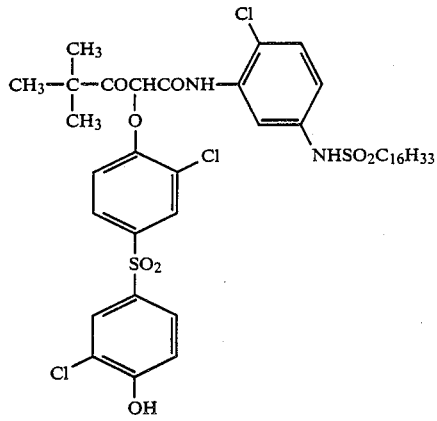

(IV-38)

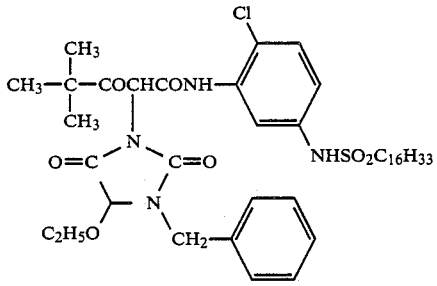

(IV-39)

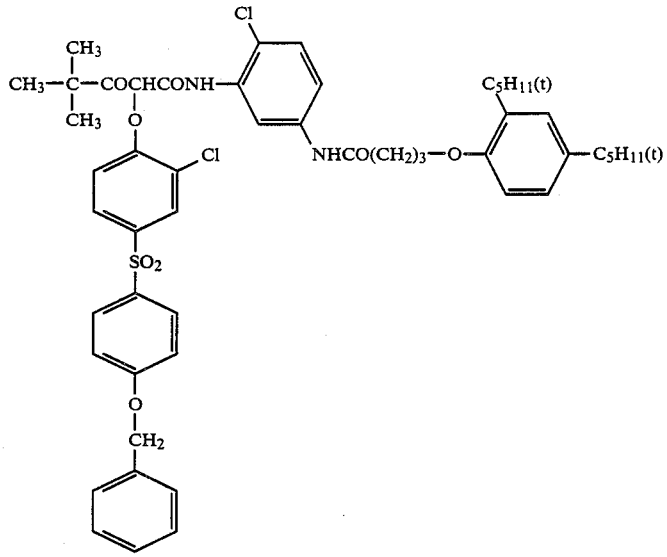

The couplers represented by the formula (I) and/or (II), (III), and (IV) are each incorporated in a silver halide emulsion layer constituting a light-sensitive layer in an amount of usually from 0.1 to 1.0 mole, preferably from 0.1 to 0.5 mole, per mole of the silver halide. As to the proportions of the respective couplers represented by the formulae (I) and/or (II), (III), and (IV), they are usually incorporated in molar ratios of about 1:0.2 to 1.5:0.5 to 1.5 though ratios outside the ranges may be employed for designing light-sensitive materials.

In the present invention, the above-described couplers may be added to light-sensitive layers by applying various known techniques. Usually, they can be added according to an oil-in-water dispersion process known as an oil protection process. For example, couplers are first dissolved in a single or mixed solvent of high-boiling organic solvents such as phthalates (e.g., dibutyl phthalate, dioctyl phthalate, etc.) or phosphates (e.g., tricresyl phosphate, trinonyl phosphate, etc.) and low-boiling organic solvents such as ethyl acetate, and then emulsified and dispersed in a gelatin aqueous solution containing a surfactant. Alternatively, water or a gelatin aqueous solution may be added to a coupler solution containing a surfactant, followed by phase inversion to obtain an oil-in-water dispersion. Alkali-soluble couplers may also be dispersed according to a so-called Fischer's dispersion process. The coupler dispersion may be subjected to distillation, noodle water-washing, ultrafiltration, or the like to remove the low-boiling organic solvent and then mixed with a photographic emulsion.

In order to introduce the yellow coupler, magenta coupler, and cyan coupler of the present invention into emulsion layers, high-boiling organic solvents having a boiling point of 160° C. or above, such as alkyl phthalates (e.g., dibutyl phthalate, dioctyl phthalate, etc.), phosphates (e.g., diphenyl phosphate, triphenyl, phosphate, tricresyl phosphate, dioctylbutyl phosphate, etc.), citrates (e.g., tributyl acetylcitrate, etc.), benzoates (e.g., octyl benzoate, etc.), alkylamides (e.g., diethyllaurylamide, etc.), fatty acid esters (e.g., dibutoxyethyl succinate, dioctyl azelate, etc.), phenols (e.g., 2,4-di-t-amylphenol, etc.), or the like, or low-boiling organic solvents having a boiling point of from 30° C. to 150° C., such as lower alkyl acetates (e.g., ethyl acetate, butyl acetate, etc.), ethyl propionate, sec-butyl alcohol, methyl isobutyl ketone, β-ethoxyethyl acetate, methylcellulosolve acetate, etc. may be used alone or in combination as the case demands.

Two or more couplers providing the same hue may be selected from the coupler classes represented by the formulae (I) and/or (II), (III), and (IV). In this case, the couplers may be co-emulsified or may separately be emulsified and mixed. Further, anti-fading agents to be described hereinafter may be used in combination with the couplers.

Couplers represented by the formula (I) may be mixed with other known cyan couplers, but the effect of the present invention is remarkable when the cyan coupler of the present invention is used in a mixing ratio of 30% or more, preferably 50% or more. Preferable known couplers to be used together are phenolic cyan couplers described in Japanese Patent Publication No. 11572/74.

In order to attain the object of the present invention, the weight ratio of the high-boiling organic solvent to the yellow coupler of the present invention is preferably adjusted to 1.0 or less, particularly from 0.1 to 0.8.

The amount of the high-boiling organic solvent for the magenta coupler or cyan coupler is preferably decided by taking into account solubility of the coupler, developability of light-sensitive materials, etc. Usually, the amount of the high-boiling organic solvent ranges from 10% to 300% based on the magenta coupler or cyan coupler of the present invention.

If desired, special couplers other than the couplers of the present invention represented by the foregoing formulae may be incorporated in the light-sensitive material of the present invention. For example, colored magenta couplers may be incorporated in a green-sensitive emulsion layer to impart a masking effect. Development inhibitor-releasing couplers (DIR couplers), development inhibitor-releasing hydroquinones, etc. may be used in emulsion layers of respective color sensitivities or in layers adjacent thereto. Development inhibitors to be released upon the development provide interlayer effects such as improvement of image sharpness, formation of fine-grained image, improvement of monochromatic saturation.

Couplers capable of releasing a development accelerator or a nucleating agent upon development of silver may be added to photographic emulsion layers of the present invention or layers adjacent thereto to obtain effects of improving photographic sensitivity and graininess of color image, and making gradation contrast.

In the present invention, a ultraviolet light absorbent may be added to any layer. Preferably, it is incorporated in a layer containing the compound represented by the formula (I) or (II) or a layer adjacent thereto. Ultraviolet light absorbents to be used in the present invention are those compounds which are listed in *Research Disclosure*, RD No. 17643, VIII, item C, and are preferably benzotriazole derivatives represented by the following formula (XVII):

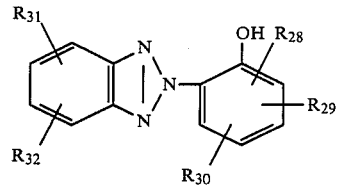

(XVII)

wherein $R_{28}$, $R_{29}$, $R_{30}$, $R_{31}$, and $R_{32}$, which may be the same or different, each represents a hydrogen atom or a substituent acceptable for the aforesaid $R_1$, or $R_{31}$ and $R_{32}$ may be cyclized each other to form a 5- or 6-membered aromatic ring comprising carbon atoms. Of these, those which may have a substituent or substituents may further be substituted by a substituent or substituents acceptable for $R_1$.

The compound represented by the formula (XVII) may be used alone or in combination of two or more. Typical examples of the ultraviolet light absorbent are illustrated below as UV-1 to UV-19.

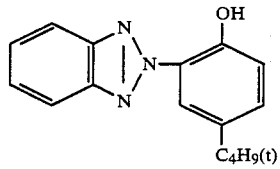

(UV-1)

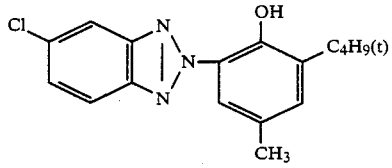

(UV-2)

-continued
(UV-3)
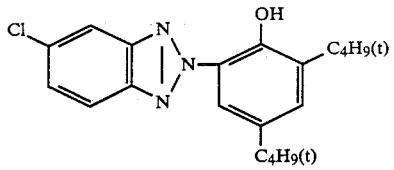
(UV-4)
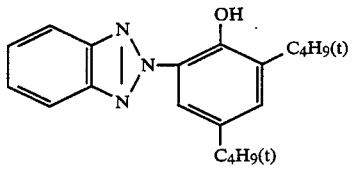
(UV-5)
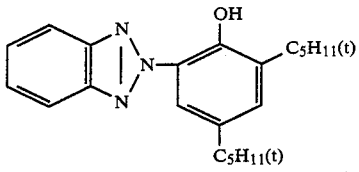
(UV-6)
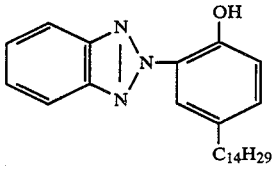
(UV-7)
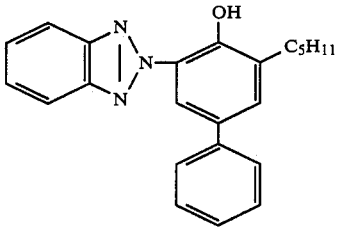
(UV-8)
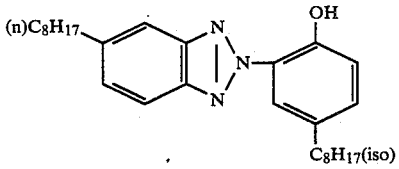
(UV-9)
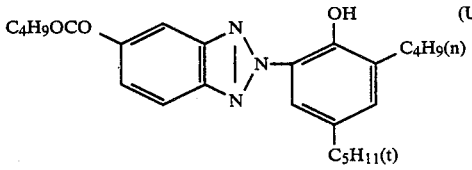
(UV-10)
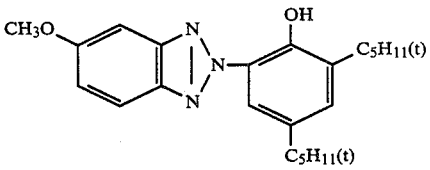
-continued
(UV-11)
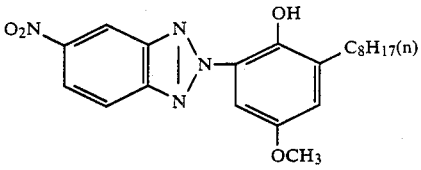
(UV-12)
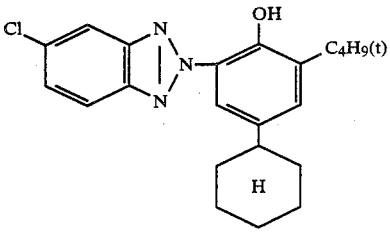
(UV-13)
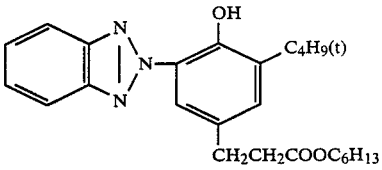
(UV-14)
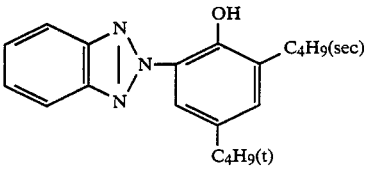
(UV-15)
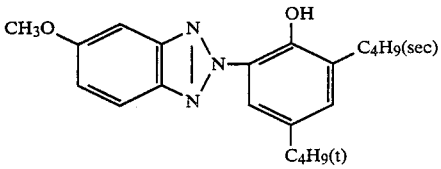
(UV-16)
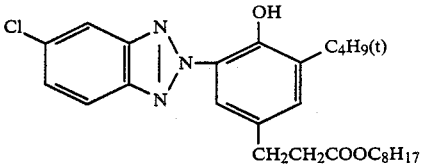
(UV-17)
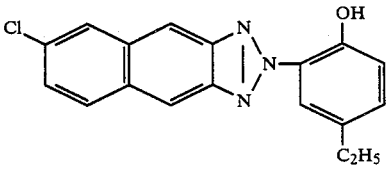
(UV-18)
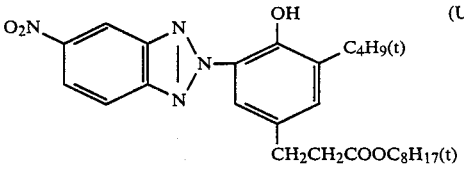

-continued

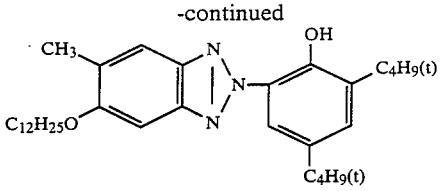

(UV-19)

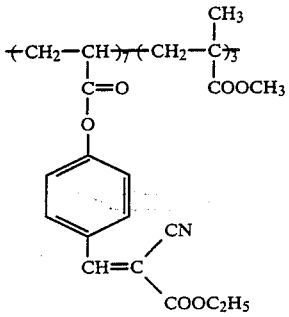

(UV-20)

Processes for synthesizing the compound represented by the foregoing formula (XVII) or examples of other compounds are described in Japanese Patent Publication No. 29620/69, Japanese Patent Application (OPI) Nos. 151149/75 and 95233/79, U.S. Pat. No. 3,766,205, European Patent No. 0057160, *Research Disclosure,* RD No. 22519 (1983), etc. In addition, high molecular weight ultraviolet light absorbents described in Japanese Patent Application (OPI) Nos. 111942/83, 178351/83, 181041/83, 19945/84, and 23344/84, can also be used. A specific example thereof has been shown as UV-20. The low molecular weight ultraviolet light absorbent and the high molecular weight ultraviolet light absorbent may be used in combination.

The above-described ultraviolet light absorbent is dissolved in a single or mixed solvent of the high-boiling and low-boiling organic solvents, and the resulting solution is dispersed in a hydrophilic colloid.

The amounts of the high-boiling organic solvent and the ultraviolet light absorbent are not particularly limited, but the high-boiling organic solvent is usually used in an amount of from 0% to 300% based on the weight of the ultraviolet light absorbent. Compounds which are liquid at an ordinary temperature are preferably used alone or in combination.

Combined use of the ultraviolet light absorbent represented by the foregoing formula (XVII) with a combination of the couplers of the present invention serves to improve preservability, particularly light fastness, of formed dye images, especially cyan images. This ultraviolet light absorbent may be co-emulsified with the cyan coupler.

As to the amount of the ultraviolet light absorbent, is suffices to add it in an enough amount to impart to the cyan dye image stability against light but, when used in a too excess amount, it sometimes causes yellowing of unexposed portions (white background) of the color photographic material. Therefore, the amount is usually selected between $1\times10^{-4}$ mole/m$^2$ and $2\times10^{-3}$ mole/m$^2$, particularly $5\times10^{-4}$ mole/m$^2$ to $1.5\times10^{-3}$ mole/m$^2$.

In the light-sensitive stratum structure of a usual color paper, the ultraviolet light absorbent is incorporated in at least one (preferably both) of layers adjacent to a cyan coupler-containing red-sensitive emulsion layer. In the case of adding the ultraviolet light absorbent in an interlayer between a green-sensitive layer and a red-sensitive layer, it may be co-emulsified with a color mixing-preventing agent. Where the ultraviolet light absorbent is added to a protective layer, another protective layer may be provided as an outermost layer. A matting agent with an arbitrary particle size, or the like may be incorporated in this protective layer.

In order to improve preservability of formed dye images, particularly yellow and magenta images, various organic and metal complex type anti-fading agents may be used. As the organic anti-fading agents, there are illustrated hydroquinones, gallic acid derivatives, p-alkoxyphenols, p-hydroxyphenols, etc. and, as to dye image stabilizers, stain-preventing agents, and antioxidants, related patents are cited in *Research Disclosure,* RD No. 17643, items I to J. The metal complex type anti-fading agents are described in, for example, *Research Disclosure,* RD No. 15162, etc.

In order to improve fastness of yellow images against heat and light, many compounds belonging to phenols, hydroquinones, hydroxychromans, hydroxycoumarans, hindered amines, and alkyl ethers, silyl etherss or hydrolyzable precursors thereof may be used. However, compounds represented by the following formulae (XVIII) and (XIX) are effective for simultaneously improving light fastness and heat fastness of yellow images formed from the coupler of the formula (IV):

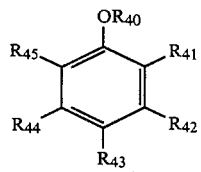

(XVIII)

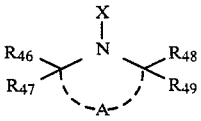

(XIX)

wherein $R_{40}$ represents a hydrogen atom, an aliphatic group, an aromatic group, a heterocyclic group, or a substituted silyl group or

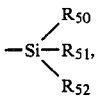

in which $R_{50}$, $R_{51}$, and $R_{52}$, which may be the same or different, each represents an aliphatic group, an aromatic group, an aliphatic oxy group, or an aromatic oxy group, each of which may be substituted by a substituent or substituents acceptable for $R_1$; $R_{41}$, $R_{42}$, $R_{43}$, $R_{44}$, and $R_{45}$, which may be the same or different, each represents a hydrogen atom, an alkyl group, an aryl group, an alkoxy group, a hydroxyl group, a mono- or dialkylamino group, an imino group, or an acylamino group; $R_{46}$, $R_{47}$, $R_{48}$, and $R_{49}$, which may be the same or different, each represents a hydrogen atom or an alkyl group; X represents a hydrogen atom, an aliphatic group, an acyl group, an aliphatic or aromatic sulfonyl group, an aliphatic or aromatic sulfinyl group, an oxy radical group, or a hydroxyl group; and A represents a non-metallic atom necessary for forming a 5-, 6-, or 7-membered ring.

Examples of the compounds represented by the formula (XVIII) or (XIX) are illustrated below, which, however, are not limitative at all.

B-1
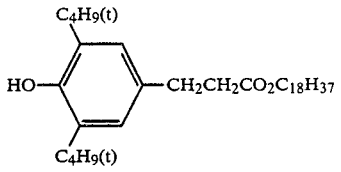
B-2
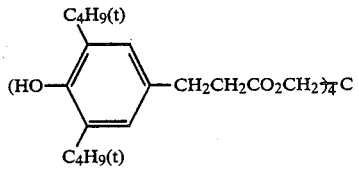
B-3
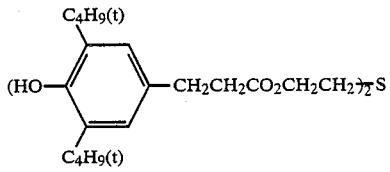
B-4
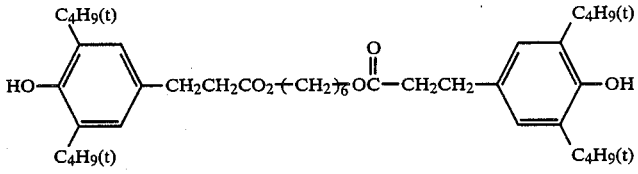
B-5
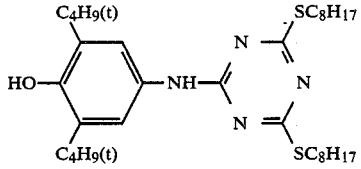
B-6
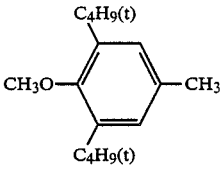
B-7
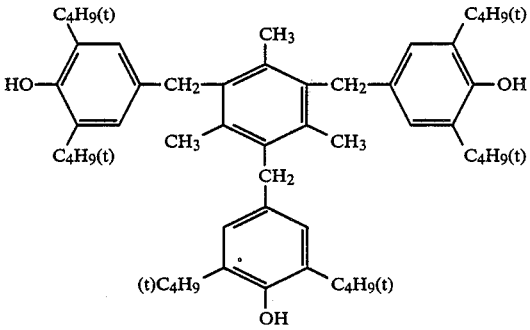
B-8
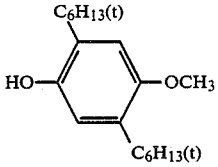

-continued
B-9
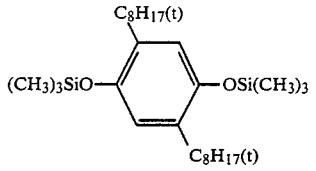
B-10
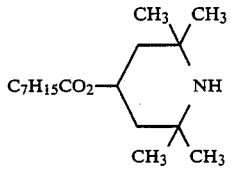
B-11
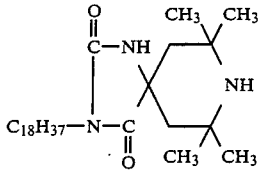
B-12
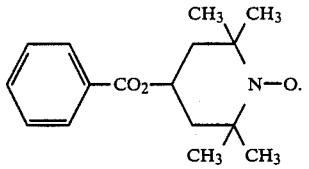
B-13
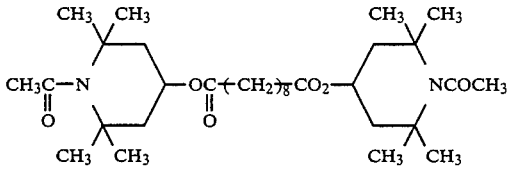
B-14
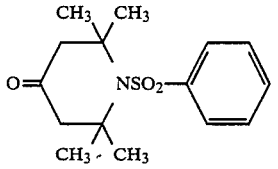
B-15
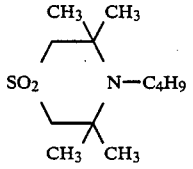
B-16
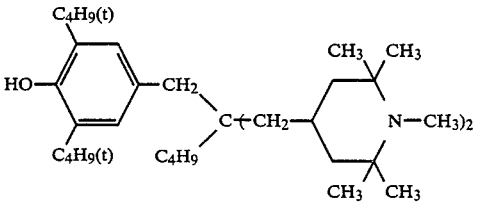
B-17
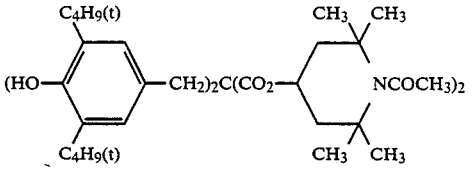

-continued

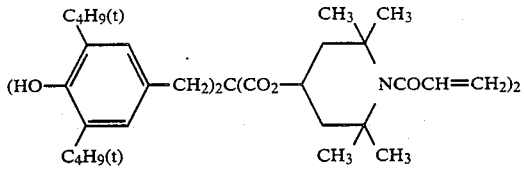

B-18

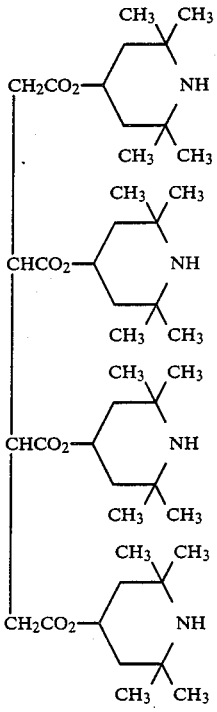

B-19

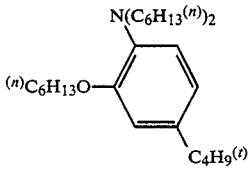

B-20

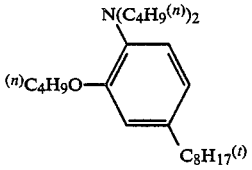

B-21

Processes for synthesizing the compounds represented by the formula (XVIII) or (XIX) and examples of other compounds than those described above are described in British Pat. Nos. 1,326,889, 1,354,313, and 1,410,846, U.S. Pat. Nos. 3,336,135 and 4,268,593, Japanese Patent Publication Nos. 1420/76 and 6623/77, and Japanese Patent Application (OPI) Nos. 114036/83 and 5246/84.

The compounds represented by the formulae (XVIII) and (XIX) may be used in combination of two or more and, further, may be used in combination with conventionally know anti-fading agents.

The amounts of the compounds represented by the formulae (XVIII) and (XIX) vary depending upon the kind of the yellow coupler to be used together, but the intended object can be attained by using the compounds in amounts of from 0.5 to 200 wt%, preferably from 2 to 150 wt%, based on the yellow coupler. It is preferable to co-emulsify them with the yellow coupler represented by the formula (IV).

The aforementioned various dye stabilizers, stain-preventing agents, or antioxidants are effective for improving preservability of magenta color dyes of the coupler of the present invention represented by the formula (III). Compounds represented by the following formulae (XX) to (XXVII) are particularly effective for greatly improving light fastness.

(XX)

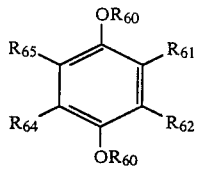

(XXI)

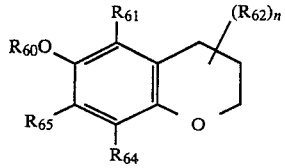

(XXII)

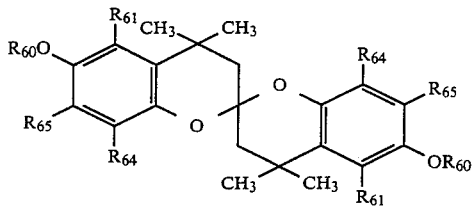

(XXIII)

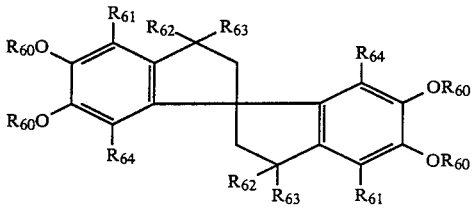

(XXIV)

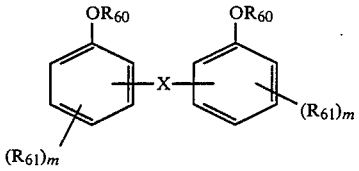

(XXV)

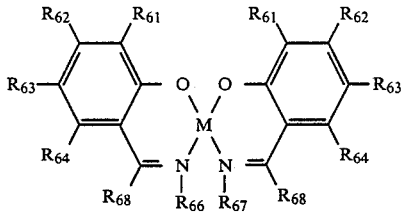

(XXVI)

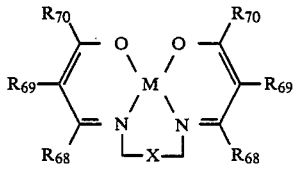

(XXVII)

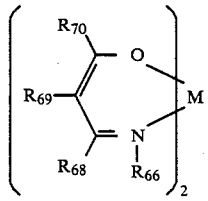

In the above formulae (XX) to (XXVII), $R_{60}$ is the same as defined for $R_{40}$ in the formula (XVIII); $R_{61}$, $R_{62}$, $R_{63}$, $R_{64}$, and $R_{65}$, which may be the same or different, each represents a hydrogen atom, an aliphatic group, an aromatic group, a mono- or di-alkylamino group, an aliphatic or aromatic thio group, an acylamino group, an aliphatic or aromatic oxycarbonyl group or —$OR_{40}$, or $R_{60}$ and $R_{61}$, $R_{61}$ and $R_{62}$, may be taken together to form a 5- or 6-membered ring; X represents a divalent linking group; $R_{66}$ and $R_{67}$, which may be the same or different, each represents a hydrogen atom, an aliphatic group, an aromatic group, or a hydroxyl group; $R_{68}$ and $R_{69}$, which may be the same or different, each represents a hydrogen atom, an aliphatic group, or an aromatic group; $R_{70}$ represents an aliphatic group or an aromatic group; or $R_{66}$ and $R_{67}$ may be taken together to form a 5- or 6-membered ring; $R_{68}$ and $R_{69}$, or $R_{69}$ and $R_{70}$, may be taken together to form a 5- or 6-membered ring; M represents Cu, Co, Ni, Pd, or Pt; when the substituent $R_{61}$ to $R_{70}$ are aliphatic or aromatic groups, they may be substituted by those substituents which are acceptable for $R_1$; n represents an integer of from 0 to 6; and m represents an integer of from 0 to 4, with n and m being the numbers of $R_{62}$ and $R_{61}$, respectively, and, when they represent 2 or more, $R_{62}$'s or $R_{61}$'s may be the same or different.

In the formulae (XXIV) and (XXVI), perferably typical examples of X are

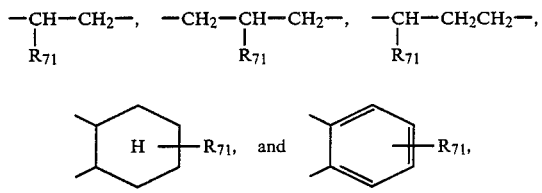

wherein $R_{71}$ represents a hydrogen atom or an alkyl group.

In the formula (XXV), $R_{61}$ preferably represents a group capable of forming a hydrogen bond. Those compounds wherein at least one of $R_{62}$, $R_{63}$, and $R_{64}$ represents a hydrogen atom, a hydroxyl group, an alkyl group, or an alkoxy group are preferable, and the substituents $R_{61}$ to $R_{68}$ preferably represent substituents respectively containing 4 or more carbon atoms in the whole.

Specific examples of the compounds represented by the formulae (XX) to (XXVII) are shown below, which, however, are not limitative at all.

G-1

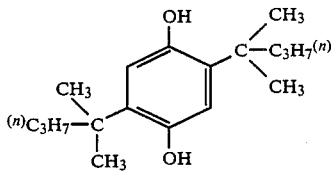

G-2

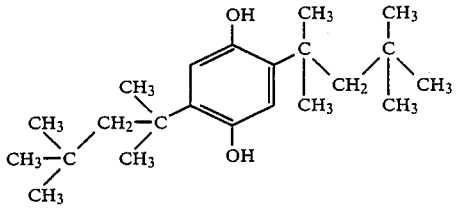

-continued
G-3
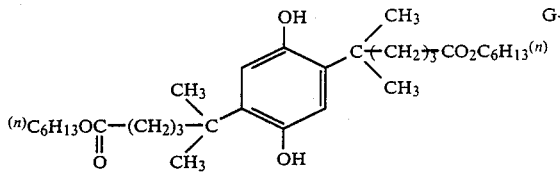
G-4
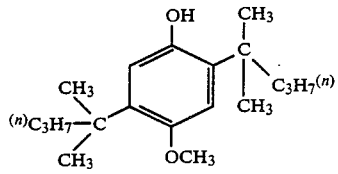
G-5
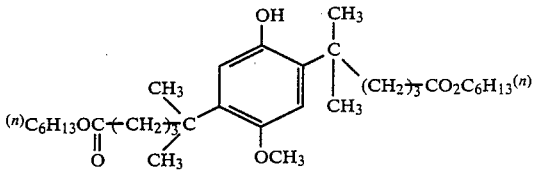
G-6
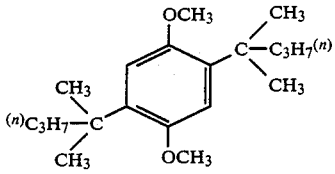
G-7
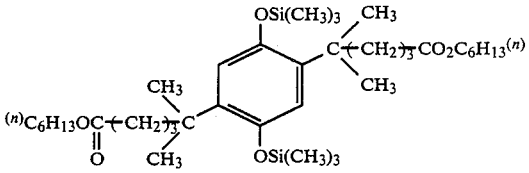
G-8
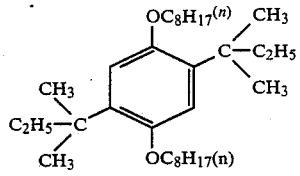
G-9
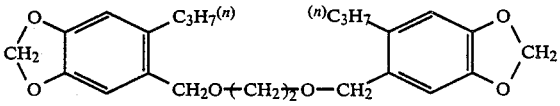
G-10
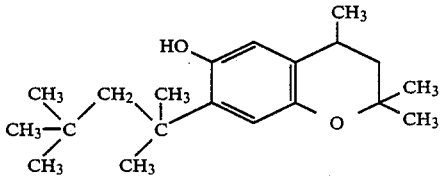
G-11
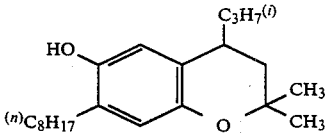
-continued
G-12
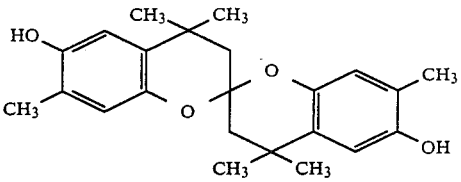
G-13
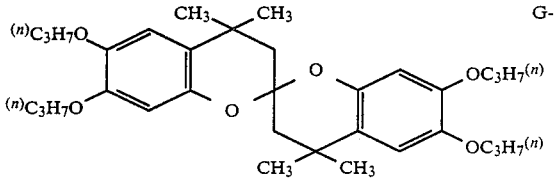
G-14
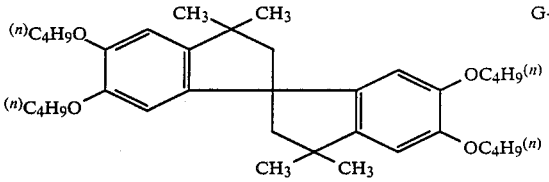
G-15
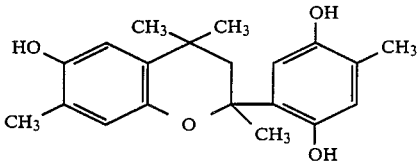
G-16
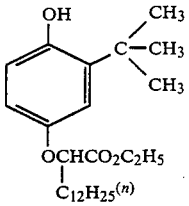
G-17
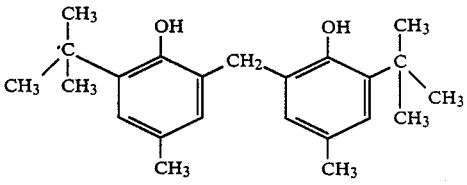
G-18
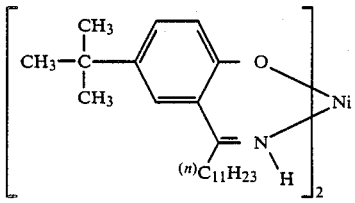

-continued

G-19

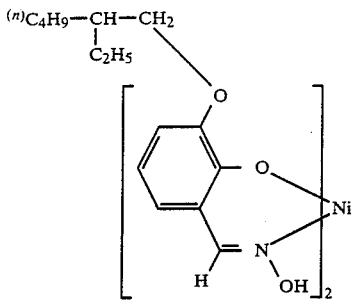

G-20

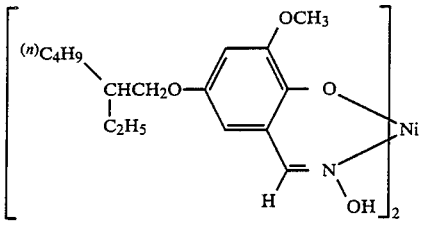

G-21

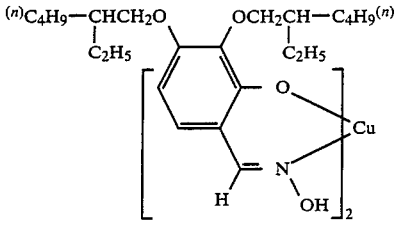

G-22

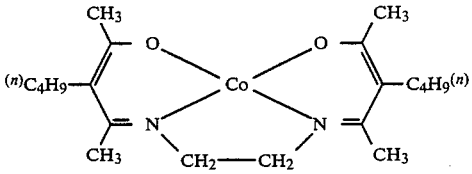

G-23

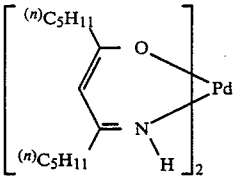

Processes for synthesizing these compounds and examples of other compounds are described in U.S. Pat. Nos. 3,336,135, 3,432,300, 3,573,050, 3,574,627, 3,700,455, 3,764,337, 3,935,016, 3,982,944, 4,254,216, and 4,279,990; British Pat. Nos. 1,347,556, 2,062,888, 2,066,975, and 2,077,455; Japanese Patent Application (OPI) Nos. 152225/77, 17729/78, 20327/78, 145530/79, 6321/80, 21004/80, 24141/83, 10539/84, and 97353/85; and Japanese Patent Publication Nos. 31625/73 and 12337/79.

Of the anti-fading agents to be used in the present invention, those compounds which are represented by the formulae (XX) to (XXIV) are added in amounts of from 10 to 200 mole%, preferably from 30 to 100 mole%, based on the magenta coupler of the present invention. On the other hand, the compound represented by the formula (XXV) is added in an amount of from 1 to 100 mole%, preferably from 5 to 40 mole%, based on the magenta coupler of the present invention. These compounds are preferably co-emulsified with the magenta coupler.

As techniques for preventing color fading, a technique of surrounding a dye image by an oxygen barrier layer composed of a substance with a low oxygen permeation ratio is disclosed in, for example, Japanese Patent Application (OPI) Nos. 11330/74 and 57223/75, and a technique of providing a layer having an oxygen permeation ratio of 20 ml/m$^2$.hr.atom or less in the support side of a color image-forming layer of a color photographic material is disclosed in Japanese Patent Application (OPI) No. 85747/81. These techniques can be applied to the present invention.

Various silver halides may be used in the silver halide emulsion layer of the present invention. For example, there are illustrated silver chloride, silver bromide, silver chlorobromide, silver iodobromide, silver chloroiodobromide, etc., with silver iodobromide containing from 2 to 20 mole% silver iodide and silver chlorobromide containing from 10 to 50 mole% silver bromide being preferable. Silver halide grains are not limited as to crystal form, crystal structure, grain size, grain size distribution, etc. Crystals of silver halide may be either of normal crystal or twin, and may be any of hexahedron, octahedron, and tetradecahedron. In addition, tabular grains having a thickness of 0.5$\mu$ or less, a diameter of at least 0.6$\mu$, and an average aspect ratio of 5 or more, as described in *Research Disclosure,* RD No. 22534, may be used.

Crystal structure may be uniform or of a structure wherein the inner portion and the outer portion are different from each other in halide composition, or may be stratiform. Further, silver halide crystals different from each other in composition may be conjuncted by epitaxial conjunction or silver halide crystals may comprise a mixture of grains of various crystal forms. In addition, silver halide grains of the type forming a latent image mainly on the surface thereof and grains of the type forming a latent image mainly within them may be used.

As to grain size of silver halide grains, fine grains having a grain size of not more than 0.1$\mu$ and large-sized grains having a grain size of up to 3$\mu$ in projected area diameter may be used. A monodispersed emulsion having a narrow grain size distribution and a polydispersed emulsion having a broad distribution may be used.

These silver halide grains may be prepared according to processes conventionally employed in the art.

The aforementioned silver halide emulsion may be sensitized by ordinarily employed chemical sensitization process, i.e., sulfur sensitization process, noble metal sensitization process, or a combination thereof. Further, the silver halide emulsion of the present invention may be provided with color sensitivity in desired light-sensitive wavelength region by using sensitizing dyes. Dyes to be advantageously used in the present invention include methine dyes and styryl dyes, such as cyanines, hemicyanines, rhodacyanines, merocyanines, oxonols, hemioxonols, etc. These dyes may be used alone or as a combination of two or more.

As supports to be used in the present invention, any of transparent supports such as polyethylene terephthalate and cellulose triacetate and reflective supports as described hereinafter may be used, with the latter reflective supports being preferable. As the reflective supports, there are illustrated, for example, baryta paper, polyethylene-coated paper, polypropylene synthetic paper, transparent supports having provided thereon a reflective layer or having a reflective substance, such as glass sheet, polyester films (e.g., polyethylene terephthalate, cellulose triacetate, or cellulose nitrate), polyamide film, polycarbonate film, polystyrene film, etc. These supports may appropriately be selected depending upon the purpose for use.

Blue-sensitive emulsions, green-sensitive emulsions and red-sensitive emulsions used in the present invention are those spectrally sensitized so as to have color sensitivities using methine dyes or other dyes, respectively. Examples of dyes which can be used include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

To these dyes are applicable as a basic heterocyclic nucleus any of nuclei conventionally employed for cyanine dyes. That is, there are illustrated a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei where alicyclic hydrocarbon rings are fused on the foregoing nuclei; and nuclei where aromatic hydrocarbon rings are fused on the foregoing nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may be substituted on a carbon atom.

To merocyanine dyes or complex merocyanine dyes, 5- or 6-membered heterocyclic nuclei such as a pyrazolin-5-one nucleus, a thiohydantoin nucleus, a 2-thiobarbituric acid nucleus, etc. may be applied as a nucleus having a ketomethylene structure.

These sensitizing dyes may be used alone or in combination thereof. Combinations of sensitizing dyes are, in particular, often used for the purpose of supersensitization. Typical examples thereof are described in U.S. Pat. Nos. 2,688,545, 2,977,229, 3,397,060, 3,522,052, 3,527,641, 3,617,293, 3,638,964, 3,666,480, 3,672,898, 3,679,428, 3,703,377, 3,769,301, 3,814,609, 3,837,862, and 4,026,707; British Pat. Nos. 1,344,281 and 1,507,803; Japanese patent publication Nos. 4936/68 and 12375/78; and Japanese patent application (OPI) Nos. 110618/77 and 109925/77.

Dyes which do not themselves have a sensitizing function or substances which do not substantially absorb a visible light but exhibit supersensitization may be incorporated in emulsions in combination with the sensitizing dye.

In the color photographic light-sensitive material of the present invention, a subsidiary layer such as a subbing layer, an interlayer, and a protective layer can be provided in addition to the above-described constituting layers. Further, a second ultraviolet light absorbing layer may be provided between a red-sensitive silver halide emulsion layer and a green-sensitive silver halide emulsion layer, if desired. In such a ultraviolet light absorbing layer, the above-described ultraviolet light absorbents are preferably used, but other known ultraviolet light absorbents may be employed.

Gelatin is advantageously used as binders or protective colloids for photographic emulsions, but other hydrophilic colloids can also be used.

For example, it is possible to use proteins such as gelatin derivatives, graft polymers of gelatin and other polymers, albumin, or casein, etc., saccharose derivatives such as cellulose derivatives such as hydroxyethyl cellulose, carboxymethyl cellulose, or cellulose sulfate, etc., sodium alginate or starch derivatives, etc., and synthetic hydrophilic high molecular weight substances such as homo- or copolymers, e.g., as polyvinyl alcohol, polyvinyl alcohol partial acetal, poly-N-vinyl pyrrolidone, polyacrylic acid, polymethacrylic acid, polyacrylamide, polyvinyl imidazole, or polyvinyl pyrazole, etc.

As gelatin, not only lime-processed gelatin but also acid treated gelatin and enzyme treated gelatin as described in *Bull. Soc. Sci. Phot. Japan,* No. 16, page 30 (1966) may be used. Further, hydrolyzed products or enzymatic decomposition products of gelatin can also be used.

In the light-sensitive material of the present invention, the photographic emulsion layers and other hydrophilic colloid layers may contain whitening agents such as stilbene type, triazine type, oxazole type, or coumarine type whitening agents. They may be water-soluble, and water-insoluble whitening agents may be used in the form of a dispersion. Specific examples of suitable fluorescent whitening agents are described in U.S. Pat. Nos. 2,632,701, 3,269,840, and 3,359,102; British Pat. Nos. 852,075 and 1,319,763; and *Research Disclosure,* Vol. 176, RD No. 17643, page 24, left column, lines 9 to 36, "Brighteners" (December, 1978), etc.

In the light-sensitive material of the invention, when dyes, ultraviolet light absorbents, and the like are incorporated into the hydrophilic colloid layers, they may be mordanted with cationic polymers, etc. For example, polymers as described in British Pat. No. 685,475; U.S. Pat. Nos. 2,675,316, 2,839,401, 2,882,156, 3,048,487, 3,184,309, and 3,445,231; West German patent application (OLS) No. 1,914,362; and Japanese patent application (OPI) Nos. 47624/75 and 71332/75 can be used.

The light-sensitive material of the present invention may contain therein hydroquinone derivatives, aminophenol derivatives, gallic acid derivatives, ascorbic acid derivatives, etc., as color fog preventing agents. Specific examples thereof are described in U.S. Pat. Nos. 2,360,290, 2,336,327, 2,403,721, 2,418,613, 2,673,314, 2,701,197, 2,704,713, 2,728,659, 2,732,300, and 2,735,765; Japanese patent application (OPI) Nos. 92988/75, 92989/75, 93928/75, 110337/75, and 146235/77; and Japanese patent publication No. 23813/75.

To the color photographic light-sensitive material of the present invention, various photographic additives known in this field, for example, stabilizers, antifoggants, surface active agents, couplers other than the present invention, filter dyes, irradiation preventing dyes, developing agents can be added in addition to the above described compounds, if desired.

Further, to silver halide emulsion layers or other hydrophillic colloid layers, substantially light-insensitive fine grain silver halide emulsions (for example, a silver chloride, silver bromide, or silver chlorobromide emulsion having an average particle size of 0.20$\mu$ or less) may be added, if desired.

Color developing solutions used in the present invention are preferably alkaline aqueous solutions containing aromatic primary amine color developing agents as main components. Typical examples of the color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.

The color developing solutions can further contain pH buffering agents such as sulfites, carbonates, borates, or phosphates of alkali metals, etc., development inhibitors or antifogging agents such as bromides, iodides, or organic antifogging agents, etc. In addition, if desired, the color developing solutions can also contain water softeners; preservatives such as hydroxylamine, etc.; organic solvents such as benzyl alcohol, diethylene glycol, etc.; development accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone, etc.; viscosity-imparting agents; polycarboxylic acid type chelating agents as described in U.S. Pat. No. 4,083,723; antioxidants as described in West German patent application (OLS) No. 2,622,950; and the like.

After color development, the photographic emulsion layer is usually subjected to a bleaching processing. This bleach processing may be performed simultaneously with a fixing processing, or they may be performed independently.

Bleaching agents which can be used include compounds of polyvalent metals, for example, iron (III), cobalt (III), chromium (VI), and copper (II), peracids, quinones and nitroso compounds. For example, ferricyanides; dichromates; organic complex salts of iron (III) or cobalt (III), for example, complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

After color development or bleach-fixing processing step, washing with water may be conducted.

Color development can be practiced at an appropriate temperature ranging from 18° to 55° C. Color development is conducted preferably at 30° C. or higher and particularly at 35° C. or higher. The time necessary for development is in a range from about 1 minute to about 3.5 minutes and the shorter time is preferred. For continuous development processing, it is preferred to practice replenishing of processing solutions. Replenisher of 160 ml or less per $m^2$ and preferably 100 ml or less per $m^2$ of the photographic materials to be processed may be employed. A concentration of benzyl alcohol in the developing solution is preferably 5 ml or less per liter thereof.

Bleach-fixing can be practiced at an appropriate temperature ranging from 18° to 50° C., and preferably at 30° C. or higher. When the bleach-fixing is conducted at 35° C. or higher, it is possible to shorten the processing time to a range of 1 minute or less and to reduce an amount of replenisher to be added. The time necessary for washing with water after color development or bleach-fixing is usually within 3 minutes.

Dyes formed are degradated not only with light, heat or temperature but also by mold during preservation. Since cyan color images are particularly degradated by mold, it is preferred to employ antimolds. Specific examples of antimolds include 2-thiazolylbenzimidazoles as described in Japanese patent application (OPI) No. 157244/82. Antimolds can be incorporated into the light-sensitive material or may be added thereto from outside during development processing. Antimolds can be included in photographic materials in any appropriate steps as far as photographic materials after processing contain them.

The present invention will be explained in greater detail with reference to the following examples, but the present invention should not be construed as being limited thereto.

EXAMPLE 1

A multilayered color photographic printing paper comprising a paper support, both surfaces of which were laminated with polyethylene, and having provided thereon the stratum structure shown in Table 1 was prepared. Coating solutions were prepared as follows.

Preparation of a coating solution for forming a first layer:

10 ml of ethyl acetate and 4 ml of solvent (c) were added to 10 g of yellow coupler (a) and 23 g of color image stabilizer (b) to dissolve, and the resulting solution was emulsified and dispersed in 90 ml of a 10% gelatin aqueous solution containing 5 ml of 10% sodium dodecylbenzenesulfonate. On the other hand, 90 g of a blue-sensitive emulsion was prepared by adding a blue-sensitive dye shown below to a silver chlorobromide emulsion (containing 80 mole% of silver iodide and 70 g/kg of silver) in an amount of $4.0\times10^{-4}$ mole per mole of silver chlorobromide.

The emulsion dispersion and the emulsion were mixed to prepare a solution, and gelatin was added thereto to adjust the concentrations of the ingredients to the composition shown in Table 1. Thus, a coating solution for forming a first layer was prepared.

Coating solutions for a second layer to a seventh layer were prepared in the same manner as with the coating solution for the first layer. 2-Hydroxy-4,6-dichloro-s-triazine sodium salt was used as a gelatin hardener for each layer.

As the spectral sensitizing agents, following ones were used.

Blue-sensitive emulsion layer:

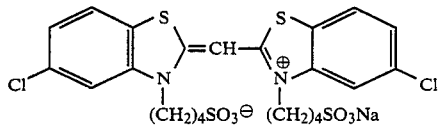

(added in an amount of $4.0\times10^{-4}$ mole per mole of silver halide)

Green-sensitive emulsion layer:

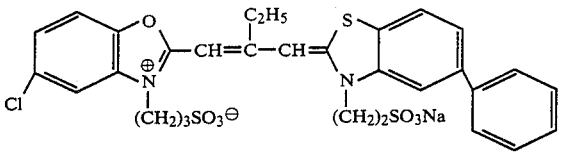

(added in an amount of $3.0\times10^{-4}$ mole per mole of silver halide)

Red-sensitive emulsion layer:

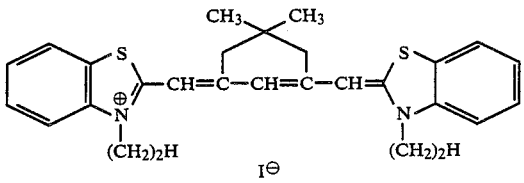

(added in an amount of $1.0\times10^{-4}$ mole per mole of silver halide)

As the irradiation-preventing dyes for the respective emulsion layers, following ones were used.

Green-sensitive emulsion layer:

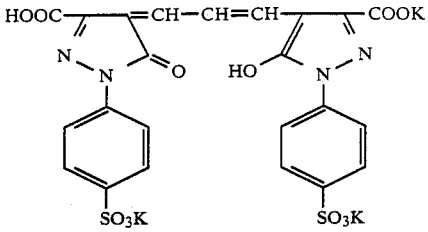

Red-sensitive emulsion layer:

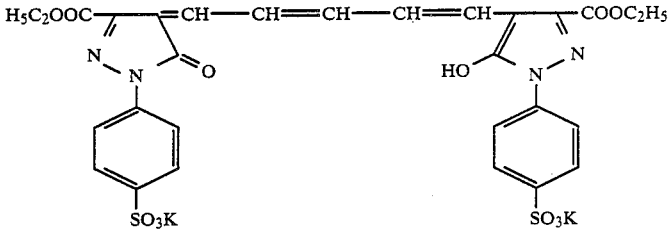

Structural formulae of the couplers, etc. used in this Example are as follows.

(a) Yellow coupler:

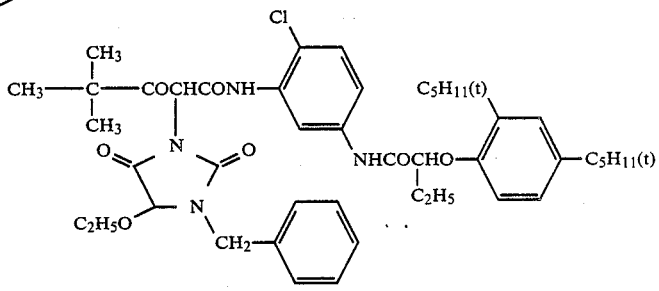

(b) Image stabilizer:

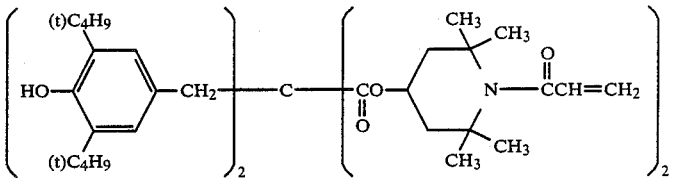

(c) Solvent:

$(isoC_9H_{19}O)_3P{=}O$ (d) Color mixing-preventing agent:

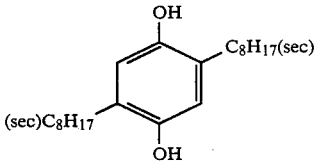

(e) Magenta coupler:

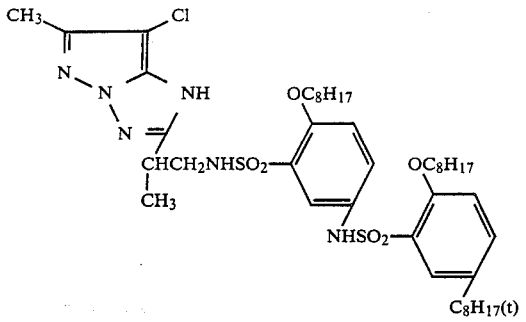
(f) Image stabilizer:
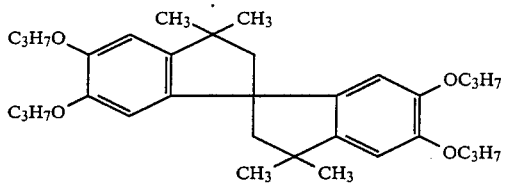
(g) Solvent:
2:1 (by weight) of mixture of
$(C_8H_{17}O)_3P{=}O$ and (
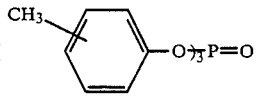
(h) Ultraviolet light absorbent:
1:5:3 (by mole) mixture of
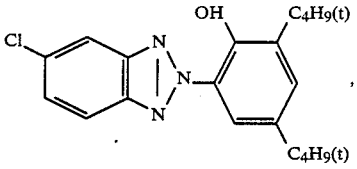
,
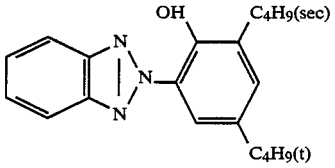
and
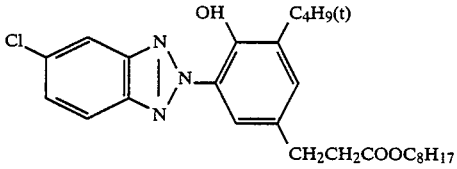
(i) Color mixing-preventing agent:
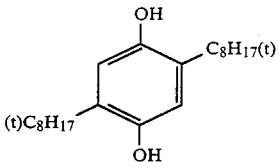
(j) Solvent:
$(isoC_9H_{19}O)_3P{=}O$
(k) Cyan coupler:
2:1 (by mole) mixture of
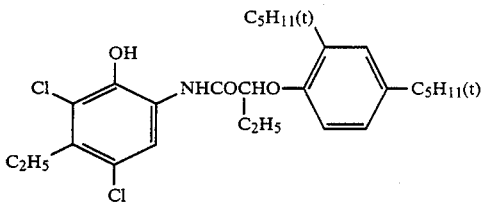
($k_1$)
and
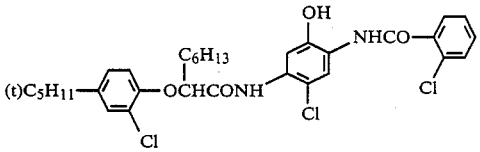
($k_2$)
(l) Image stabilizer:
1:3:3 (by mole) mixture of
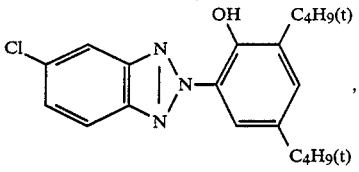
,
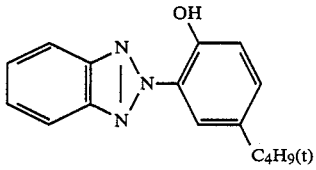
and
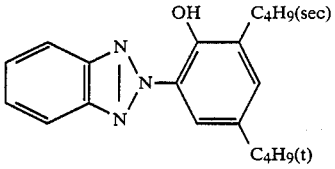
(m) Solvent:

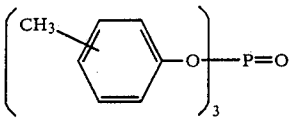

TABLE 1

| Layer | Main-Formulation | Amount Used |
|---|---|---|
| 7th Layer (Protective layer) | Gelatin | 1.33 g/m$^2$ |
| | Acrylic-modified polyvinyl alcohol copolymer (modification: 17%) | 0.17 g/m$^2$ |
| 6th Layer (UV light absorbing layer) | Gelatin | 0.54 g/m$^2$ |
| | UV light absorbent (h) | 5.10 × 10$^{-4}$ mol/m$^2$ |
| | Solvent (j) | 0.08 g/m$^2$ |
| 5th Layer (Red-sensitive layer) | Silver chlorobromide emulsion (AgBr: 70 mol %) | 0.22 g/m$^2$ (as Ag) |
| | Gelatin | 0.90 g/m$^2$ |
| | Cyan coupler (k) | 7.05 × 10$^{-4}$ mol/m$^2$ |
| | Image stabilizer (1) | 5.20 × 10$^{-4}$ mol/m$^2$ |
| | Solvent (m) | 0.22 g/m$^2$ |
| 4th Layer (UV light absorbing layer) | Gelatin | 1.60 g/m$^2$ |
| | UV light absorbent (h) | 1.70 × 10$^{-4}$ mol/m$^2$ |
| | Color mixing-preventing agent (i) | 1.60 × 10$^{-4}$ mol/m$^2$ |
| | Solvent (j) | 0.24 g/m$^2$ |
| 3rd Layer (Green-sensitive layer) | Silver chlorobromide emulsion (AgBr: 75 mol %) | 0.15 g/m$^2$ (as Ag) |
| | Gelatin | 1.56 g/m$^2$ |
| | Magenta coupler (e) | 3.38 × 10$^{-4}$ mol/m$^2$ |
| | Image stabilizer (f) | 0.19 g/m$^2$ |
| | Solvent (g) | 0.59 g/m$^2$ |
| 2nd Layer (Color mixing-preventing layer) | Gelatin | 0.90 g/m$^2$ |
| | Color mixing-preventing agent (d) | 2.33 × 10$^{-4}$ mol/m$^2$ |
| lst Layer (Blue-sensitive layer) | Silver chlorobromide emulsion (AgBr: 80 mol %) | 0.35 g/m$^2$ (as Ag) |
| | Gelatin | 1.35 g/m$^2$ |
| | Yellow Coupler (a) | 6.91 × 10$^{-4}$ mol/m$^2$ |
| | Image stabilizer (b) | 0.13 g/m$^2$ |
| | Solvent (c) | 0.02 g/m$^2$ |
| Support | Polyethylene-laminated paper (containing a white pigment ($TiO_2$ or the like) and a bluish dye (ultramarine or the like) in polyethylene coated on the side of the first layer) | |

After balancing surface tension and viscosity of the coating solutions for forming the first to seventh layers, they were simultaneously coated to prepare a multilayered silver halide photographic material. This color photographic material was referred to as Sample 101.

Then, Samples 102 to 104 were prepared in the same manner except for the changes as shown in Table 2. After being subjected to gradation exposure for sensitometry, these samples were developed according to the following processing steps.

| Processing Step | Temperature | Time |
|---|---|---|
| Color development | 33° C. | 3'30" |
| Bleach-fixing | 33° C. | 1'30" |
| Washing with water | 24 to 34° C. | 3' |
| Drying | 80° C. | 1' |

Formulations of the processing solutions were as shown below.

| | |
|---|---|
| Color developer: | |
| Water | 800 ml |
| Diethylenetriaminepentaacetic acid | 3.0 g |
| Benzyl alcohol | 15 ml |
| Diethylene glycol | 10 ml |
| Sodium sulfite | 2.0 g |

-continued

| | |
|---|---|
| Potassium bromide | 0.5 g |
| Potassium carbonate | 30.0 g |
| N—Ethyl-N—(β-methanesulfonamidoethyl)-3-methyl-4-aminoaniline sulfate) | 5.0 g |
| Hydroxylamine sulfate | 4.0 g |
| Fluorescent whitening agent (4,4'-distilbene type) | 1.0 g |
| Water to make | 1000 ml |
| pH (25° C.) | 10.10 |
| Bleach-fixing solution: | |
| Water | 400 ml |
| Ammonium thiosulfate (70% solution) | 150 ml |
| Sodium sulfite | 18 g |
| Iron (III) ammonium ethylenediaminetetraacetate | 55 g |
| Disodium ethylenediaminetetraacetate | 5 g |
| Water to make | 1000 ml |
| pH (25° C.) | 6.70 |

TABLE 2

| Sample | Content of the change from Sample 101 |
|---|---|
| 102 | Magenta coupler (e) in the third layer was replaced by an equimolar amount of illustrative compound III-1. |
| 103 | Magenta coupler (e) in the third layer was replaced by an equimolar amount of illustrative compound III-15. |
| 104 | Magenta coupler (e) in the third layer was replaced by an equimolar amount of illustrative compound III-10. |

Sensitivities, fogs, and peak wavelengths of spectral reflection of these samples are shown in Table 3. All of Samples 101 to 104 immediately after being processed showed a fog of 0.05. Fogs and densities of these samples after being preserved at 35° C. and 80% RH (relative humidity) for 3 days and of these samples after being preserved at 80° C. and 70% RH for 14 days are also shown in Table 3. Fogs under the conditions of 80° C. and 70% RH were measured in terms of yellow density, and fogs under the other conditions were measured in terms of magenta color density.

TABLE 3

| Sample | Sensitivity | Fog (M) | Peak Wavelength (nm) | 35° C., 80%, 3 Days Density (M) | 35° C., 80%, 3 Days Fog (M) | 80° C., 70%, 14 Days Density (M) | 80° C., 70%, 14 Days Fog (M) |
|---|---|---|---|---|---|---|---|
| 101* | 100 | 0.09 | 547 | 1.00 | 0.12 | 1.22 | .21 |
| 102** | 97 | 0.09 | 531 | 1.00 | 0.09 | 1.02 | 0.16 |
| 103** | 102 | 0.09 | 531 | 1.00 | 0.10 | 1.04 | 0.18 |
| 104** | 97 | 0.09 | 536 | 1.00 | 0.09 | 1.00 | 0.15 |

*Comparative example
**Example of the present invention

Sensitivities were presented as a relative value of an exposure amount giving a density of 0.8, taking that of Sample 101 as 100. Densities after being preserved were measured at a point where the density before the preservation was 1.0.

After preserving for 3 days at 35° C. and 80% RH, no changes were observed in gradation portion, whereas fog (Dmin) was changed. With the comparative sample, the density was increased, whereas with the samples of the present invention, the density was not changed at all or only slightly changed. After preserving for 14 days at 80° C. and 70% RH, change in density was observed even in gradation portions. However, the comparative sample underwent a serious increase in density, whereas the samples of the present invention underwent only a small increase. As to the fog of yellow density (stain with a magenta coupler), the samples of the present invention underwent less increase.

As to the change in cyan density and change in yellow density after the preservation at 80° C. and 70% RH for 14 days, the cyan density was changed from 1 to 0.94, and the yellow density from 1 to 1.02. As to the change in color balance from neutral gray, the comparative sample underwent a serious change to a red to magenta tint, whereas the samples of the present invention underwent a slight change to a red tint. Thus, it is seen that the samples of the present invention showed excellent results with respect to color image preservability, particularly change in color balance.

Further, color reproducibility was examined by preparing a print with neutral gray from a color negative-working film on which a Macbeth color rendering chart had been photographed, using each of the samples of the present invention. In the print prepared from the comparative sample, saturation of a red patch was insufficient, and a magenta patch had a cyan tint. With the prints prepared from the samples of the present invention, Samples 102 and 103 provided extremely high saturation, though a red patch had a slightly orange tint, thus showing good color reproducibility. Sample 104 showed the best color reproducibility for a red patch and a magenta patch. Thus, it is seen that the samples of the present invention show excellent properties with respect to color reproducibility as well.

EXAMPLE 2

Samples 105 to 108 were prepared in the same manner as with Samples 101 and 104 of Example 1 except for the change shown in Table 4 and were subjected to the same preservation test as in Example 1 of preserving at 80° C. and 70% RH for 14 days.

TABLE 4

| Sample | Content of the change from Sample 101 |
|---|---|
| 105 | Cyan coupler (k) in the 5th layer of Sample 101 was replaced by an equimolar amount of the following cyan coupler C-1 |
| 106 | Cyan coupler (k) in the 5th layer of Sample 104 was replaced by an equimolar amount of the following cyan coupler C-1 |
| 107 | Cyan coupler (k) in the 5th layer of Sample 101 was replaced by an equimolar amount of ($k_1$) alone. |
| 108 | Cyan coupler (k) in the 5th layer of Sample 104 was replaced by an equimolar amount of ($k_1$) alone. |

Changes in magenta density and yellow density of these samples were the same as with Samples 101 and 104, and change in cyan density was as follows.

TABLE 5

| Sample | Cyan Density (80° C., 70%, 14 Days) | Note |
|---|---|---|
| 105 | 0.72 | Comparative Example |
| 106 | 0.70 | Present Invention |
| 107 | 0.90 | Comparative Example |
| 108 | 0.89 | Present Invention |

Cyan Coupler C-1:

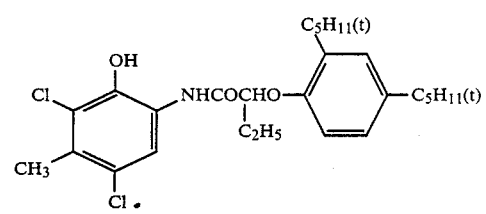

Samples 105 and 106 underwent a considerable change from neutral gray to a red tint. However, Sample 106 underwent a less shift from gray due to no increase in magenta density.

Samples 107 and 108 showed a slightly red tint. However, like the relation between Sample 101 and Sample 104 in Example 1, Sample 108 underwent a less change in gray balance, thus being found to be excellent.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon a red-sensitive layer containing at least one of couplers represented by formulae (I) and/or (II), a green-sensitive layer containing at least one of couplers represented by the following formula (III-2) or formula (III-3), and a blue-sensitive layer containing at least one of couplers represented by the following formula (IV):

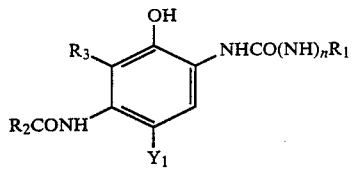
(I)

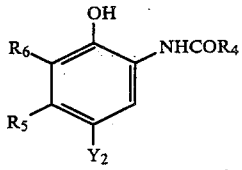
(II)

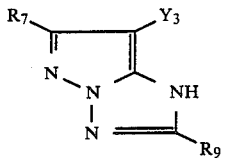
(III-2)

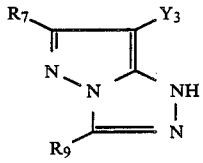
(III-3)

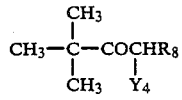
(IV)

wherein:

$R_1$, $R_2$, and $R_4$ each represents a substituted or unsubstituted aliphatic, aromatic or heterocyclic group;

$R_3$, $R_5$, and $R_6$ each represents a hydrogen atom, a halogen atom, an aliphatic group, an aromatic group, or an acylamino group, or, when taken together, $R_3$ and $R_2$ represent non-metallic atoms necessary for forming a nitrogen-containing 5- or 6-membered ring;

$R_7$ represents an alkoxy group, an aryloxy group, or a heterocyclic oxy group;

$R_8$ represents a substituted or unsubstituted N-phenylcarbamoyl group;

wherein $R_9$ represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; or $R_9$ represents a divalent group forming a bis-compound;

Za and Zb each represents methine, substituted methine, or =N—;

$Y_1$, $Y_2$, $Y_3$ and $Y_4$ each represents a hydrogen atom or a group capable of being split off upon coupling reaction with an oxidation product of a developing agent; and n represents 0 or 1.

2. A photographic material as in claim 1, wherein when $Y_1$, $Y_2$, $Y_3$, or $Y_4$ represents a group capable of being split off upon reaction with an oxidation product of a developing agent, said group represents a group capable of connecting a coupling-active carbon atom to an aliphatic group, an aromatic group, a heterocyclic group, an aliphatic, aromatic, or heterocyclic sulfonyl group, or an aliphatic, aromatic, or heterocyclic carbonyl group via an oxygen atom, a nitrogen atom, a sulfur atom, or a carbon atom; a halogen atom; or an aromatic azo group.

3. A photographic material as in claim 2, wherein said group capable of being split off upon coupling reaction with an oxidation product of a developing agent is a halogen atom; an alkoxy group; an aryloxy group; an acyloxy group; an aliphatic or aromatic sulfonyloxy group; an acylamino group; an aliphatic or aromatic sulfonamido group; an alkoxycarbonyloxy group; an aryloxycarbonyloxy group; an aliphatic, aromatic, or hetrocyclic thio group; a 5- or 6-membered nitrogen-containing heterocyclic group; an imido group; or an aromatic azo group.

4. A photographic material as in claim 1, wherein $R_1$ in the formula (I) represents an aryl group or a heterocyclic group.

5. A photographic material as in claim 4, wherein $R_1$ in the formula (I) represents an aryl group substituted by a halogen atom, an alkyl group, an alkoxy group, an aryloxy group, an acylamino group, an acyl group, a carbamoyl group, a sulfonamido group, a sulfamoyl group, a sulfonyl group, an oxycarbonyl group, or a cyano group.

6. A photographic material as in claim 1, wherein when $R_3$ and $R_2$ in the formula (I) do not jointly form a ring, $R_2$ represents a substituted or unsubstituted alkyl or aryl group; and $R_3$ represents a hydrogen atom.

7. A photographic material as in claim 6, wherein $R_2$ represents a substituted aryloxy-substituted alkyl group.

8. A photographic material as in claim 1, wherein $R_4$ in the formula (II) represents a substituted or unsubstituted alkyl or aryl group.

9. A photographic material as in claim 8, wherein $R_4$ represents a substituted aryloxy-substituted alkyl group.

10. A photographic material as in claim 1, wherein $R_5$ in the formula (II) represents an alkyl group containing from 2 to 15 carbon atoms or a methyl group having a substituent containing 1 or more carbon atoms.

11. A photographic material as in claim 10, wherein $R_5$ represents an alkyl group having from 2 to 15 carbon atoms.

12. A photographic material as in claim 11, wherein $R_5$ represents an alkyl group having from 2 to 4 carbon atoms.

13. A photographic material as in claim 1, wherein $R_6$ in the formula (II) represents a hydrogen atom or a halogen atom.

14. A photographic material as in claim 13, wherein $R_6$ represents a chlorine atom or a fluorine atom.

15. A photographic material as in claim 1, wherein $Y_1$ and $Y_2$ in the formulae (I) and (II) each represents a hydrogen atom, a halogen atom, an alkoxy group, an aryloxy group, an acyloxy group, or a sulfonamido group.

16. A photographic material as in claim 15, wherein $Y_2$ represents a halogen atom.

17. A photographic material as in claim 16, wherein $Y_2$ represents a chlorine atom or a fluorine atom.

18. A photographic material as in claim 1, wherein when n in the formula (I) represents O, $Y_1$ represents a halogen atom.

19. A photographic material as in claim 18, wherein $Y_1$ represents a chlorine atom or a fluorine atom.

20. A photographic material as in claim 1, wherein the coupler represented by the formula (III) is a magenta coupler represented by the formula (III-2).

21. A photographic material as in claim 1, wherein $R_8$ in the formula (IV) is a group represented by (IVA)

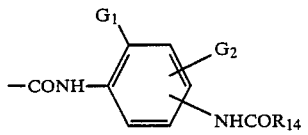

wherein $G_1$ represents a halogen atom or an alkoxy group; $G_2$ represents a hydrogen atom, a halogen atom, or an alkoxy group; and $R_{14}$ represents an alkyl group.

22. A photographic material as in claim 1, wherein when $Y_4$ in the formula (IV) represents a group capable of being split off upon coupling reaction with an oxidation product of a developing agent, said group is represented by one of the following formulae (X) to (X)

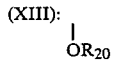

wherein $R_{20}$ represents an aryl or heterocyclic group;

(XI)

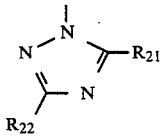

(XII)

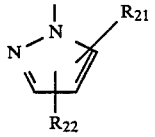

wherein $R_{21}$ and $R_{22}$, which may be the same or different, each represents a hydrogen atom, a halogen atom, a carboxylic acid ester group, an amino group, an alkylsulfonyl group, an alkylthio group, an alkoxy group, an alkylsulfonyl group, an alkylsulfinyl group, a carboxylic acid group, a sulfonic acid group, a phenyl group, or a heterocyclic group;

(XIII)

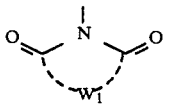

wherein $W_1$ represents a non-metallic atom necessary for forming a 4-, 5-, or 6-membered ring together with

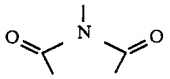

in the formula.

23. A photographic material as in claim 22, wherein the group represented by the formula (XIII) is a wherein the group represented by the formula (XIII) is a group represented by one of the following formulae (XIV) to (XVI):

(XIV)

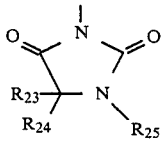

(XV)

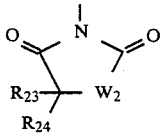

(XVI)

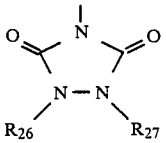

wherein $R_{23}$ and $R_{24}$ each represents a hydrogen atom, an alkyl group, an aryl group, an alkoxy group, an aryloxy group, or a hydroxyl group; $R_{25}$, $R_{26}$, and $R_{27}$ each represents a hydrogen atom, an alkyl group, an aryl group, an aralkyl group, or an acyl group; and $W_2$ represents an oxygen atom or a sulfur atom.

24. A photographic material as in claim 1, wherein the couplers represented by the formulae (I) and/or (II), (III), and (IV) are incorporated in a silver halide emulsion layer constituting the light-sensitive layer in an amount of from 0.1 to 1.0 mole per mole of the silver halide, respectively.

25. A photographic material as in claim 1, wherein the couplers represented by the formulae (I) and/or (II), (III), and (IV) are incorporated in a silver halide emulsion layer constituting the light-sensitive layer in an amount of from 0.1 to 0.5 mole per mole of the silver halide, respectively.

26. A photographic material as in claim 1, wherein a ultraviolet light absorbent represented by the following formula (XVII):

(XVII)

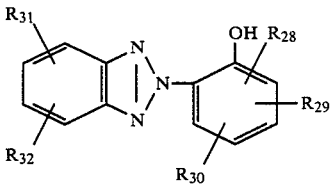

wherein $R_{28}$, $R_{29}$, $R_{30}$, $R_{31}$, and $R_{32}$, which may be the same or different, each represents a hydrogen atom or a substituents, or $R_{31}$ and $R_{32}$ may be cyclized each other to form a 5- or 6-membered aromatic ring comprising carbon atoms, is added to any one of the layer(s) of said photographic material.

27. A photographic material as in claim 26, wherein said ultraviolet light absorbent represented by the formula (XVII) is incorporated in a layer containing the compound represented by the formula (I) or (II).

28. A photographic material as in claim 1, wherein said photographic material is incorporated with a compound represented by one of the following formulae (XVIII) and (XIX):

(XVIII)

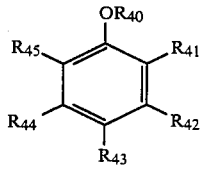

(XIX)

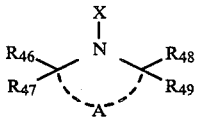

wherein $R_{40}$ represents a hydrogen atom, an aliphatic group, an aromatic group, a heterocyclic group, or a substituted silyl group or

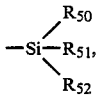

in which $R_{50}$, $R_{51}$, and $R_{52}$, which may be the same or different, each represents an aliphatic group, an aromatic group, an aliphatic oxy group, or an aromatic oxy group; $R_{41}$, $R_{42}$, $R_{43}$, $R_{44}$, and $R_{45}$, which may be the same or different, each represents a hydrogen atom, an alkyl group, an aryl group, an alkoxy group, a hydroxyl group, a mono- or dialkylamino group, an imino group, or an acylamino group; $R_{46}$, $R_{47}$, $R_{48}$, and $R_{49}$, which may be the same or different, each represents a hydrogen atom or an alkyl group; X represents a hydrogen atom, an aliphatic group, an acyl group, an aliphatic or aromatic sulfonyl group, an aliphatic or aromatic sulfinyl group, an oxy radical group, or a hydroxyl group; and A represents a nonmetallic atom necessary for forming a 5-, 6-, or 7-membered ring.

29. A photographic material as in claim 28, wherein said compound represented by the formula (XVIII) or (XIX) is a compound represented by one of the following formula (XX) to (XXVII):

(XX)

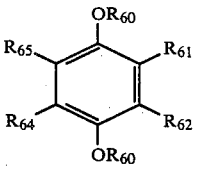

-continued (XXI)

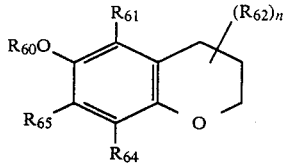

(XXII)

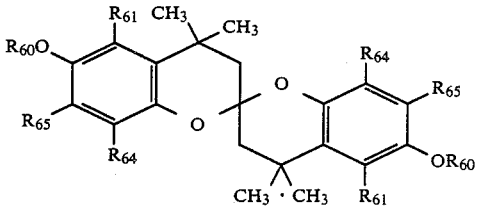

(XXIII)

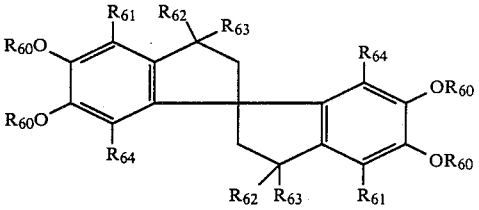

(XXIV)

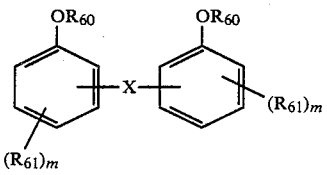

(XXV)

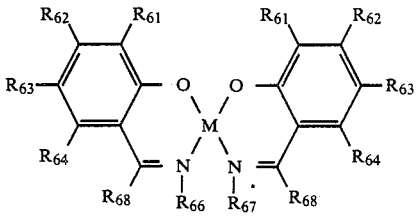

(XXVI)

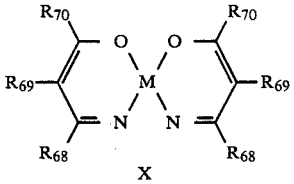

(XXVII)

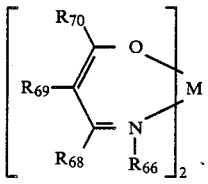

wherein $R_{60}$ is the same as defined for $R_{40}$ in the formula (XVIII); $R_{61}$, $R_{62}$, $R_{63}$, $R_{64}$, and $R_{65}$, which may be the same or different, each represents a hydrogen atom, an aliphatic group, an aromatic group, a mono- or dialkylamino group, an aliphatic or aromatic thio group, an acylamino group, an aliphatic or aromatic oxycarbonyl group, or —$OR_{40}$, or $R_{60}$ and $R_{61}$, or $R_{61}$ and $R_{62}$, may be taken together to form a 5- or 6-membered ring; X represents a divalent linking group; $R_{66}$ and $R_{67}$, which may be the same or different, each represents a hydrogen atom, an aliphatic group, an aromatic group, or a hydroxyl group; $R_{68}$ and $R_{69}$, which may be the same or different, each represents a hydrogen atom, an aliphatic group, or an aromatic group; $R_{70}$ represents an aliphatic group or an aromatic group; or $R_{66}$ and $R_{67}$ may be taken together to form a 5- or 6-membered ring; $R_{68}$ and $R_{69}$, or $R_{69}$ and $R_{70}$, may be taken together to form a 5- or 6-membered ring; M represents Cu, Co, Ni, Pd, or Pt; n represents an integer of from 0 to 6; and m represents an integer of from 0 to 4, with n and m being the numbers of $R_{62}$ and $R_{61}$, respectively, and, when they represent 2 or more, $R_{62}$'s or $R_{61}$'s may be the same or different.

30. A photographic material as in claim 29, wherein in the formulae (XXIV) and (XXVI), X represents $$-\underset{\underset{R_{71}}{|}}{CH}-CH_2-,\ -CH_2-\underset{\underset{R_{71}}{|}}{CH}-CH_2-,\ -\underset{\underset{R_{71}}{|}}{CH}-CH_2CH_2-,$$

-continued

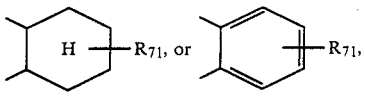

wherein $R_{71}$ represents a hydrogen atom or an alkyl group.

31. A photographic material as in claim 29, wherein in the formula (XXV), $R_{61}$ represents a group capable of forming a hydrogen bond.

32. A photographic material as in claim 1, wherein $R_7$ represents a methoxy group, an ethoxy group, an isopropoxy group, a hexyloxy group, a t-butoxy group, a dodexyloxy group, a 2-ethylhexyloxy group, a benzyloxy group, a cyclohexyloxy group, a 2-chloroethoxy group, a 2-phenoxyethoxy group, a 2-(2,4-dichlorophenoxy) ethoxy group, an allyloxy group, a phenoxy group, a 2,4-dichlorophenoxy group, a 4-methylphenoxy group, a 4-nonylphenoxy group, a 3-pentadecylphenoxy group, a 3-butanamidophenoxy group, a 2-naphthoxy group, a 1-naphthoxy group, a 4-methoxyphenoxy group, a 3,5-dimethoxyphenoxy group, a 3-cyanophenoxy group, a heterocyclic oxy group such as a pyridyloxy group, a 2-thienyloxy group, a 2-methyltetrazol-5-oxy group, a 2-benzothiazoloxy group, or a 2-pyrimidonoxy group.

* * * * *